US008042603B2

(12) United States Patent
Suzuki et al.

(10) Patent No.: US 8,042,603 B2
(45) Date of Patent: Oct. 25, 2011

(54) METHOD OF MANUFACTURING ALUMINUM ALLOY PLATE FOR LITHOGRAPHIC PRINTING PLATE, ALUMINUM ALLOY PLATE FOR LITHOGRAPHIC PRINTING PLATE OBTAINED THEREBY AND LITHOGRAPHIC PRINTING PLATE SUPPORT

(75) Inventors: Shinya Suzuki, Haibara-gun (JP); Hirokazu Sawada, Haibara-gun (JP); Hideki Miwa, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 326 days.

(21) Appl. No.: 12/372,883

(22) Filed: Feb. 18, 2009

(65) Prior Publication Data

US 2009/0226666 A1 Sep. 10, 2009

(30) Foreign Application Priority Data

Mar. 6, 2008 (JP) ..... 2008-056388

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS

2007/0095500 A1 5/2007 Numano et al.

FOREIGN PATENT DOCUMENTS

| | | | |
|---|---|---|---|
| EP | 0 928 652 | A1 | 7/1999 |
| EP | 2 008 739 | A1 | 12/2008 |
| JP | 07-132689 | A | 5/1995 |
| JP | 08-238541 | A | 9/1996 |
| JP | 3781211 | B2 | 11/1997 |
| JP | 10-052740 | | 2/1998 |
| JP | 2006-015361 | A | 1/2006 |
| JP | 2006-130545 | A | 5/2006 |
| JP | 2008-043958 | A | 2/2008 |

OTHER PUBLICATIONS

EP Communication, dated May 26, 2009, issued in corresponding EP Application No. 09152996.6, 7 pages.

*Primary Examiner* — Kuang Lin
(74) *Attorney, Agent, or Firm* — Sughrue Mion, PLLC

(57) ABSTRACT

In a method of manufacturing an aluminum alloy plate for a lithographic printing plate by continuous casting which includes feeding an aluminum alloy melt through a melt feed nozzle between a pair of cooling rollers and rolling the aluminum alloy melt while solidifying between the pair of cooling rollers, a vessel for feeding the aluminum alloy melt to the melt feed nozzle contains the aluminum alloy melt which is adjusted in such a manner that a vertical amplitude at a level of the aluminum alloy melt existing within the vessel is 10 mm or less. This manufacturing method is capable of obtaining an aluminum alloy plate for a lithographic printing plate with a uniform surface composition and manufacturing a lithographic printing plate support having no surface defect.

4 Claims, 10 Drawing Sheets

METHOD OF MANUFACTURING ALUMINUM ALLOY PLATE FOR LITHOGRAPHIC PRINTING PLATE, ALUMINUM ALLOY PLATE FOR LITHOGRAPHIC PRINTING PLATE OBTAINED THEREBY AND LITHOGRAPHIC PRINTING PLATE SUPPORT

The entire contents of all documents cited in this specification are incorporated herein by reference.

BACKGROUND OF THE INVENTION

The present invention relates to a method of manufacturing an aluminum alloy plate for a lithographic printing plate. The invention also relates to an aluminum alloy plate for a lithographic printing plate obtained by the manufacturing method described above, a lithographic printing plate support, and a presensitized plate.

The method of manufacturing aluminum alloy plate for a lithographic printing plate by continuous casting, more specifically the manufacturing method of aluminum alloy plate for a lithographic printing plate that includes a casting step involving melting an aluminum starting material to obtain an aluminum melt, filtering the aluminum melt, feeding the filtered aluminum melt through a melt feed nozzle between a pair of cooling rollers and rolling it while solidifying between the pair of cooling rollers thereby forming an aluminum alloy plate, and also includes a cold rolling step, an intermediate annealing step, a finish cold rolling step and a flatness correcting step and in which an aluminum alloy plate with a thickness of 0.1 to 0.5 mm is obtained is simple in its steps and has therefore such advantages as reduced losses, higher yield, insusceptibility to step variations, lower initial equipment cost, and lower running cost compared to a conventional method of manufacturing aluminum alloy plate for a lithographic printing plate support that includes a direct chill casting step, a scalping step, a soaking step, a heating step and a hot rolling step.

An aluminum alloy plate for use in a lithographic printing plate is generally employed after its surface has been roughened for the purpose of controlling the adhesion to the image forming layer and the balance between water retention and ink retention. In such surface roughening treatment, the surface properties of the aluminum alloy plate play an extremely important role. Important factors that may determine the properties in surface roughening treatment include not only the conditions in surface roughening treatment but also the surface composition of the aluminum alloy plate and its uniformity. Nonuniform surface composition may lead to nonuniform treatment, thus causing surface defects such as surface unevenness. It is necessary to develop a method of producing an aluminum alloy plate having a uniform surface composition in order to solve this problem.

Exemplary methods of improving the surface uniformity that are known in the art include a method in which a nozzle with a high thermal conductivity is used to enhance the uniformity in the solidification in a cross-sectional width direction (see JP 2006-15361 A), and a method in which the angle formed between the normal from the center of a roll and a meniscus formed just upstream of the roll is set within a certain range to suppress periodic variations in cooling rate (see JP 2006-130545 A).

In another respect, it is known to control the height of the melt level in order to stabilize casting. Exemplary known methods that may be used to stabilize the liquid level include a method in which a non-contact type or contact type liquid level sensor of an electromagnetic induction system is used to continuously detect the liquid level and feedback is given to a mechanism for controlling the melt flow (inflow) rate (e.g., a movable valve for preventing the melt from flowing) (see JP 3781211 B), and a method in which a dummy volume which is movable in the vertical direction is inserted and vertically moved in accordance with changes in the amount of molten metal to stabilize the melt level height (see JP 8-238541 A). These methods may be used to stabilize the liquid level height in at least several seconds or several tens of seconds.

However, these methods are all not sufficient for improving the surface defects.

In still another respect, JP 7-132689 A describes that some portions of an aluminum surface having an iron concentration of at least 1% account for 0.01 to 10% of the entire surface area. This prior art invention aims at improving the nonuniform shape of the pits formed at the surface by electrolytic graining treatment. Since the area to be analyzed for the distribution of iron as described in JP 7-132689 A is on the order of micrometers and is therefore extremely narrow, an effect of improving the uniformity in electrolytic etching during electrolytic graining treatment can be expected, but segregation over a visually noticeable range as wide as several millimeters to several tens of centimeters and surface defects cannot be improved, which indicates that such surface defects are not sufficiently improved.

SUMMARY OF THE INVENTION

The inventors of the invention have analyzed in detail the solidification process during cooling of an aluminum alloy melt, and as a result found that, when the aluminum alloy melt is fed from a melt feed nozzle between a pair of cooling rollers, the amount of the melt fed from the nozzle changes to make the surface composition of an aluminum alloy plate formed nonuniform, thus causing surface defects.

Such surface defects due to changes in the amount of the melt fed from the nozzle cannot be improved by the methods described in JP 2006-15361 A and JP 2006-130545 A.

The inventors of the invention have further found that, when the surface of the melt included in a vessel for feeding the melt to the nozzle does not vibrate, an aluminum alloy plate obtained therefrom has a uniform surface composition and the surface having undergone surface roughening treatment has no defect. In other words, it has been found that variations at the level of the melt which is present within the vessel for feeding the melt to the nozzle, and in particular minute liquid level variations occurring at an amplitude of several times per second to over several tens of times per second which are regarded as vibrations may change the amount of the melt fed from the nozzle, thus causing surface defects.

The melt level height can be stabilized in at least several seconds or several tens of seconds by the methods of controlling the melt level height as described in JP 3781211 B and JP 8-238541 A, but the aforementioned minute liquid level vibrations occurring at an amplitude of several times per second to over several tens of times per second cannot be controlled. Therefore, these methods have no effect of improving the surface defects due to changes in the amount of melt fed from the nozzle which are caused by the vibrations of the surface of the melt existing within the vessel for feeding the melt to the nozzle.

The present invention has been made under these circumstances and an object of the invention is to provide a method of manufacturing an aluminum alloy plate for a lithographic printing plate, this manufacturing method being capable of obtaining an aluminum alloy plate for a lithographic printing plate with a uniform surface composition and manufacturing a lithographic printing plate support having no surface defect.

Another object of the invention is to provide an aluminum alloy plate for a lithographic printing plate obtained by the manufacturing method described above.

Still another object of the invention is to provide a lithographic printing plate support.

Yet another object of the invention is to provide a presensitized plate.

The inventors of the invention have further made an intensive study based on the above-described findings and as a result found that part of an aluminum alloy melt having flowed into a vessel through an inflow port directly flows toward the melt surface to cause vibrations of the melt surface, and the flow of the melt forms a stationary vortical flow within the vessel to cause vibrations of the melt surface.

The inventors of the invention have repeatedly made intensive studies in order to suppress these phenomena and as a result found that, by providing a vessel having specific shape features, the vibrations at the level of the melt existing within the vessel for feeding the melt to the nozzle can be suppressed.

Based on the findings by the inventors, the invention provides a method of manufacturing an aluminum alloy plate for a lithographic printing plate by continuous casting which comprises feeding an aluminum alloy melt through a melt feed nozzle between a pair of cooling rollers and rolling the aluminum alloy melt while solidifying between the pair of cooling rollers, wherein a vessel for feeding the aluminum alloy melt to the melt feed nozzle contains the aluminum alloy melt which is adjusted in such a manner that a vertical amplitude at a level of the aluminum alloy melt existing within the vessel is 10 mm or less.

In the method of manufacturing an aluminum alloy plate for a lithographic printing plate of the invention, one or more weirs are preferably provided within the vessel as a means for reducing the vertical amplitude at the level of the aluminum alloy melt existing within the vessel to 10 mm or less.

In the method of manufacturing an aluminum alloy plate for a lithographic printing plate of the invention, the vessel is provided with inner walls of a bumpy structure as a means for reducing the vertical amplitude at the level of the aluminum alloy melt existing within the vessel to 10 mm or less.

In the method of manufacturing an aluminum alloy plate for a lithographic printing plate of the invention, a valve is provided on an outer wall side of the vessel from an inflow port through which the aluminum alloy melt is flowed into the vessel and is used as a means for reducing the vertical amplitude at the level of the aluminum alloy melt existing within the vessel to 10 mm or less.

In the method of manufacturing an aluminum alloy plate for a lithographic printing plate of the invention, the vessel with an upper opening area of at least 50×50 $cm^2$ is used as a means for reducing the vertical amplitude at the level of the aluminum alloy melt existing within the vessel to 10 mm or less.

The invention also provides an aluminum alloy plate for a lithographic printing plate obtained by the above-described manufacturing method of the invention.

The invention also provides a lithographic printing plate support obtained by subjecting the aluminum alloy plate for a lithographic printing plate to surface roughening treatment.

The invention also provides a presensitized plate having an image recording layer formed on the lithographic printing plate support of the invention.

According to the invention, an aluminum alloy plate for a lithographic printing plate having a uniform surface composition can be obtained by continuous casting. In manufacturing a lithographic printing plate support by subjecting the aluminum alloy plate obtained to surface roughening treatment, the surface of the aluminum alloy plate is roughened uniformly so that the lithographic printing plate support obtained can have no surface defects.

DETAILED DESCRIPTION OF THE INVENTION

Figure 1:
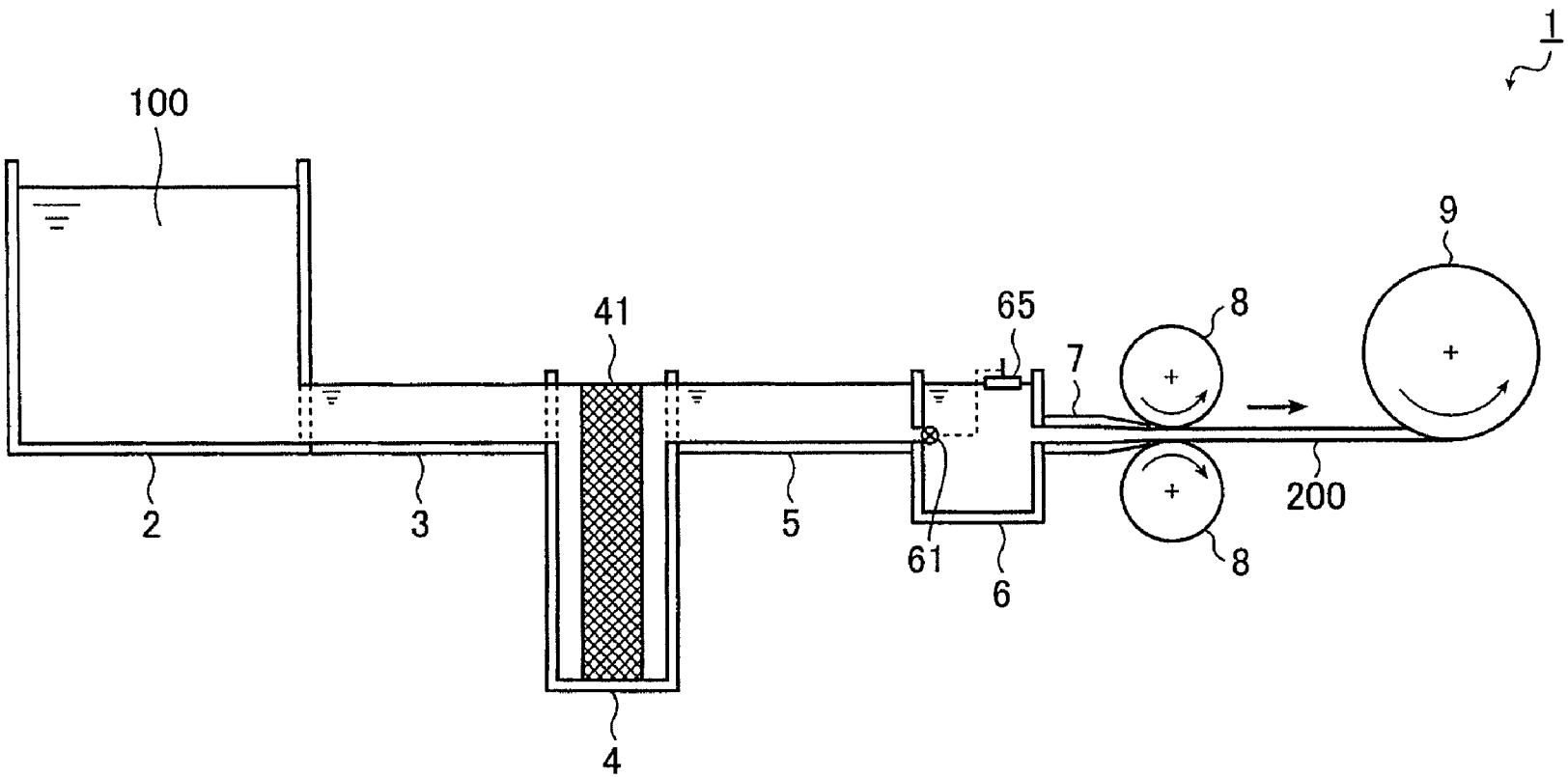
FIG. 1 is a front view showing an embodiment of a device for continuous casting and rolling in the invention.
Figure 2:
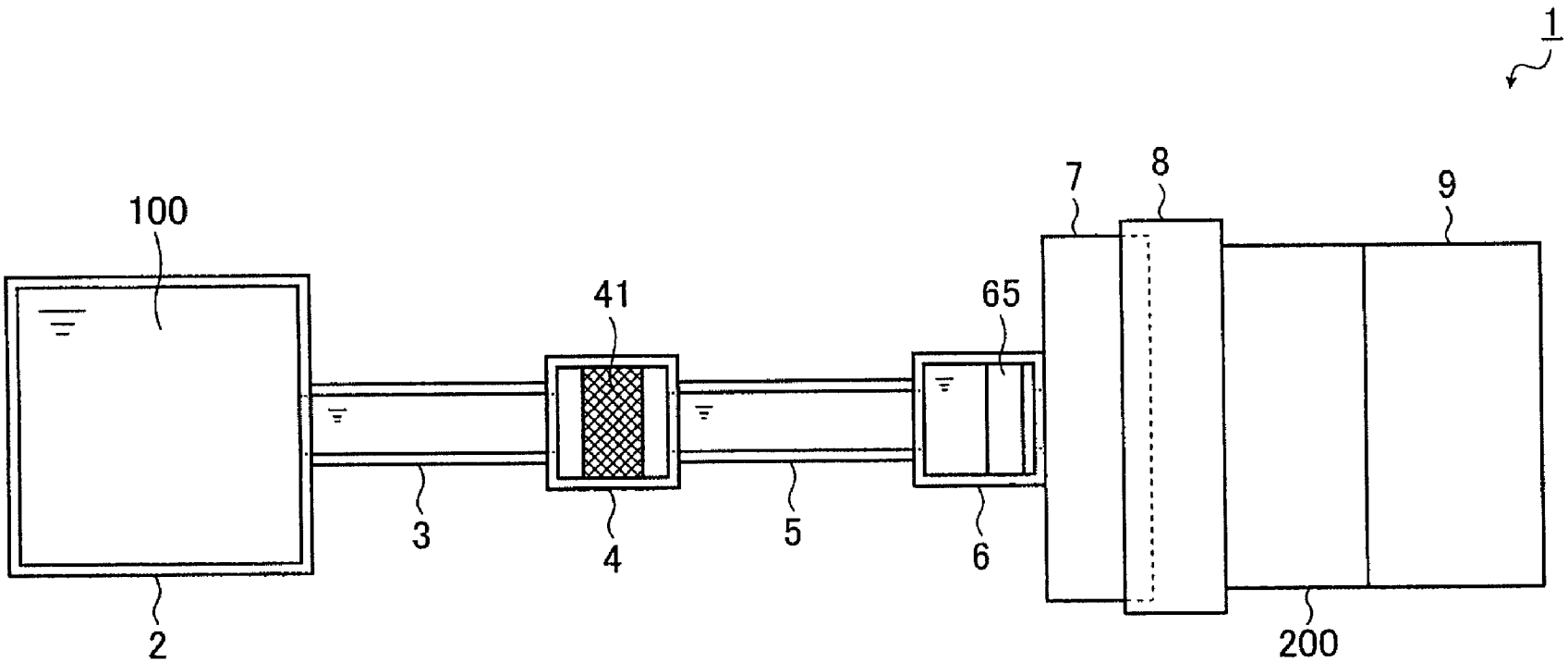
FIG. 2 is a plan view of the device for continuous casting and rolling shown in FIG. 1.

Preferred embodiments of the method of manufacturing an aluminum alloy plate for a lithographic printing plate according to the invention are described below with reference to the accompanying drawings. FIG. 1 is a front view showing an embodiment of a device for continuous casting and rolling that may be used in the method of manufacturing an aluminum alloy plate for a lithographic printing plate according to the invention. FIG. 2 is a plan view of the device shown in FIG. 1. The wall surface on the front side is omitted in FIG. 1. This is also the case for all the front views in this application.

In a device for continuous casting and rolling 1 shown in FIGS. 1 and 2, a melting and holding furnace 2 holds an aluminum alloy melt (hereinafter referred to as the "aluminum melt") 100 prepared by melting an aluminum ingot to obtain a melt, and adding iron, silicon and other elements to the melt to adjust to a desired composition. Exemplary methods for adding elements such as iron and silicon include a method of adding a mother alloy of aluminum and iron (25 wt %) and a method of adding a mother alloy of aluminum and silicon (25 wt %).

The preferred composition of the aluminum melt in the invention is described below.

Silicon is an element which is contained in an amount of around 0.03 to 0.1 wt % as an inadvertent impurity in the aluminum ingot serving as the starting material. A very small amount of silicon is often intentionally added to prevent variations due to starting material differences. Silicon is present in the state of solid solution in aluminum or as an intermetallic compound or a single deposit.

In the practice of the invention, the silicon content in the aluminum melt is preferably from 0.04 to 0.15 wt %. It should be noted here that a value of not less than 0.10 wt % is obtained by separately adding a mother alloy in addition to the silicon in the aluminum ingot.

Most of iron does not enter into solid solution in aluminum but remains as intermetallic compounds. Iron increases the mechanical strength of the aluminum alloy, exerting a large influence on the strength of the lithographic printing plate support.

When the iron content is too low, the support will have too low a mechanical strength. As a result, when the lithographic printing plate is mounted onto the plate cylinder of a printing press, the edges thereof may be readily broken. Such breakage readily occurs also when a large number of impressions are made at high speed.

On the other hand, when the iron content is too high, the support will have a higher strength than necessary. As a result, when mounted onto the plate cylinder of a printing press, the lithographic printing plate may not fit well on the cylinder and the edges thereof may be readily broken during printing. For example, at an iron content exceeding 1.0 wt %, cracking readily occurs during rolling.

In the practice of the invention, the iron content in the aluminum melt is preferably from 0.10 to 0.50 wt %.

Copper is an important element for controlling electrolytic graining treatment. Copper enters with great ease into solid solution and only a part of the copper is present as intermetallic compounds.

The copper content in the aluminum melt of the invention is preferably at least 0.01 wt % in terms of the uniform electrolytic graining and up to 0.050 wt % in terms of the diameter of the pits formed by electrolytic graining in a nitric acid solution, uniformity of the pit diameter and scumming resistance.

To prevent crack formation during casting, the aluminum melt may include elements which have a crystal grain refining effect such as titanium and boron. Crystals fully refined during casing enable crystal grains to have a smaller width even after finish cold rolling and are therefore preferable.

For example, titanium may be included within a range of 0.003 to 0.05 wt %, and boron may be included within a range of 0.001 to 0.02 wt %.

The balance of the aluminum melt is aluminum and inadvertent impurities. Examples of such impurities include magnesium, manganese, zinc, chromium, zirconium, vanadium, and beryllium. These may be present in respective amounts of up to 0.05 wt %.

Most of the inadvertent impurities will originate from the aluminum ingot. If the inadvertent impurities are what is present in an ingot having an aluminum purity of 99.7 wt %, they will not compromise the intended effects of the invention. The inadvertent impurities may be, for example, impurities included in the amounts mentioned in *Aluminum Alloys: Structure and Properties*, by L. F. Mondolfo (1976).

The aluminum melt 100 within the melting and holding furnace 2 is sent to a filtering means 4 through a first channel 3.

A filter 41 for filtering the aluminum melt 100 is provided within the filtering means 4 to remove impurities incorporated in the aluminum melt 100 and contaminants remaining in the melting furnace and melt channel.

The filtering means that may be preferably used is the one described in JP 3549080 B.

A $TiB_2$-containing mother alloy serving as the crystal grain refining material is preferably added to the aluminum melt 100 in the first channel 3. This is because addition of the crystal grain refining material facilitates refining the crystal grains during continuous casting, thus enabling occurrence of unevenness after surface treatment due to coarse crystal grains to be suppressed in the surface treatment steps for manufacturing a lithographic printing plate support.

An exemplary $TiB_2$-containing mother alloy that may be preferably used includes a mother alloy in wire form containing titanium (5%) and boron (1%) with the balance being aluminum and inadvertent impurities.

It is desirable to add the crystal grain refining material on the upstream side of the filtering means 4 in order to suppress outflow of the $TiB_2$ aggregated particles.

The aluminum melt 100 having been adjusted to a desired composition may be subjected to cleaning treatment. Exemplary cleaning treatments that may be used to remove unnecessary gases such as hydrogen in the aluminum melt include flux treatment and degassing treatment using, for example, argon gas or chlorine gas. Cleaning treatment may be carried out by an ordinary method.

Cleaning treatment is not essential but is preferably carried out to prevent defects due to foreign matter such as nonmetallic inclusions and oxides in the aluminum melt, and defects due to dissolved gases in the aluminum melt.

Filtration of the melt is usually carried out by passing the melt through a filter such as a ceramic tube filter or a ceramic foam filter. The filtration is described in, for example, JP 6-57432 A, JP 3-162530 A, JP 5-140659 A, JP 4-231425 A, JP 4-276031 A, JP 5-311261 A, and JP 6-136466 A.

Degassing of the aluminum melt is usually carried out by a process involving blowing an inert gas such as argon into the aluminum melt by a rotor so that hydrogen gas within the melt is trapped in argon bubbles and raised to the melt surface, or by flux treatment. The degassing is described in, for example, JP 5-51659 A and JP 5-49148 U. The present applicant proposes a technique concerning the degassing of an aluminum melt in JP 7-40017 A.

Although not shown, it is preferable to provide a degassing unit midway in the first channel 3 and carry out degassing treatment (hydrogen gas removal treatment) of the aluminum melt 100 prior to filtering treatment. Commercially available rotary degassing units such as SNIFF and GBF may be used for the degassing unit.

The aluminum melt 100 having passed through the filtering means 4 further passes through a second channel 5 to enter a vessel 6 for feeding the melt 100 to a melt feed nozzle 7. The vessel 6 is provided with a liquid level control mechanism which is a structure for adjusting the amount of inflow of the aluminum melt 100. Referring to FIG. 1, a float 65 at the level of the aluminum melt 100 in the vessel 6 is linked with a valve 61 provided at an inflow port of the vessel 6, and the amount of the aluminum melt 100 flowing into the vessel 6 is adjusted by opening or closing the valve 61 in accordance with changes in the height of the level of the aluminum melt 100 within the vessel 6 or changing the degree of opening of the valve. The level of the aluminum melt 100 within the vessel 6 is maintained at a substantially fixed height.

The aluminum melt 100 fed from the vessel 6 to the melt feed nozzle 7 is then fed between a pair of cooling rollers 8 positioned at a specified distance (e.g., about several millimeters to ten millimeters) from each other.

The aluminum melt 100 discharged from the melt feed nozzle 7 comes in contact with the surfaces of the cooling rollers 8, where solidification of the melt starts. A melt meniscus is formed during movement of the aluminum melt from the tip of the melt feed nozzle 7 to the surfaces of the cooling rollers 8. Vibrations of the melt meniscus cause the points of contact of the melt meniscus with the cooling rollers 8 to vibrate, as a result of which portions having different solidification histories are formed on the cooling roller surfaces and nonuniformity of the crystalline structure and segregation of trace elements are more likely to occur. Such a defect is also called "ripple mark", which may readily cause unevenness due to the surface treatments carried out for manufacturing a lithographic printing plate support after the aluminum alloy plate has been subjected to cold rolling, intermediate annealing and finish cold rolling.

In terms of reduction of such ripple mark, the tip of the melt feed nozzle 7 is preferably inclined so that at least the outer surface on the lower side of the tip forms an acute angle with the direction of discharge of the aluminum melt, whereby the aluminum melt is consistently released from one point. For example, the method described in JP 10-58094 A may be advantageously used.

Figure 3:
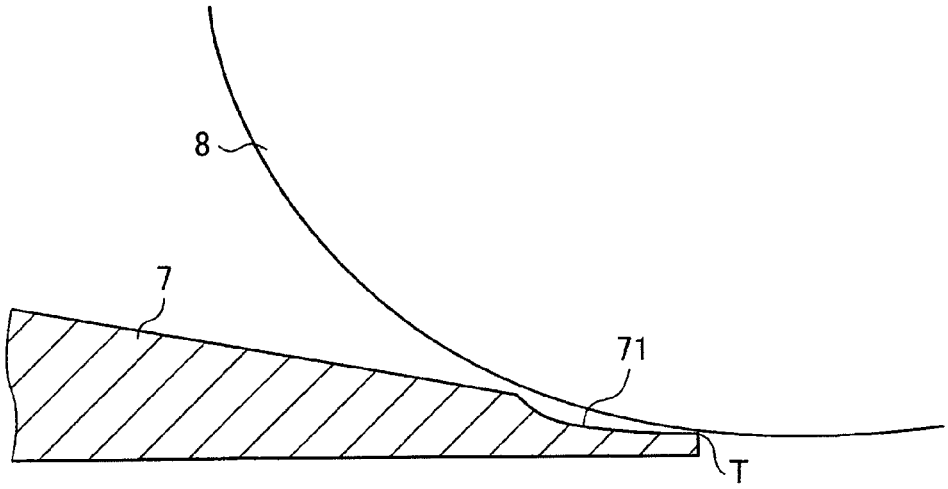
FIG. 3 is a schematic view showing a preferred example of the shape of a melt feed nozzle and the positional relation between the melt feed nozzle and the cooling roller.

FIG. 3 is a schematic view showing a preferred example of the shape of the melt feed nozzle and the positional relation between the melt feed nozzle and the cooling roller. FIG. 3 shows only the nozzle plate on the upper end side of the nozzle and the upper cooling roller, but the nozzle plate on the lower end side of the nozzle and the lower cooling nozzle have the same positional relation as that shown in FIG. 3.

FIG. 3 shows a relief (chamfer) 71 formed to avoid contact of the outer periphery of the lip portion of the melt feed nozzle 7 with the cooling roller 8 and to make the outer edge of the lip portion of the melt feed nozzle 7 come in contact with the cooling roller 8. In other words, the melt feed nozzle 7 comes in contact with the cooling roller 8 only at the tip T thereof. The relief (chamfer) is preferably provided over the entire width of the melt feed nozzle 7.

Such a structure prevents a gap serving as space for variations of the melt meniscus from being formed to enable formation of an aluminum alloy plate having no appearance defects and hence a lithographic printing plate support having more reduced appearance defects.

It is preferable to reduce the distance between the tip of the nozzle 7 and the surfaces of the cooling rollers 8 in order to reduce the amplitude during vibrations of the meniscus. Therefore, ideally, the tip of the nozzle 7 at which the outer surface on the lower side (and preferably on the lower and upper sides) forms an acute angle with the direction of discharge of the aluminum melt is always in contact with the surfaces of the cooling rollers 8.

More specifically, in a preferred embodiment, of the member forming the melt feed nozzle 7, a top plate member which comes in contact with the aluminum melt from the upper side and a bottom plate member which comes in contact with the aluminum melt from the lower side are vertically movable and the upper and bottom plate members are pressed against the surfaces of the adjoining cooling rollers 8 under pressure from the aluminum melt. For example, the embodiment described in JP 2000-117402 A can be advantageously used.

In this way, the tip of the melt feed nozzle 7 is always in contact with the cooling rollers 8 and as a result, the melt meniscus is maintained in a fixed shape, enabling a lithographic printing plate support having more reduced appearance defects to be obtained.

Even if the melt meniscus is stabilized in this way, an aluminum alloy plate obtained by continuous casting is also likely to be nonuniform due to nonuniform flow of the melt in the melt feed nozzle. It is therefore necessary for the flow of the melt within the melt feed nozzle to be made uniform. However, because the gap between the cooling rollers is from several millimeters to about ten millimeters in size and thus very small, the nozzle which feeds the melt thereto also has a very narrow construction, and so the space in the interior of the nozzle through which the aluminum melt passes is also narrow. Hence, any disruption in the smooth flow of the aluminum melt in the nozzle interior will immediately result in nonuniformity in the flow of the aluminum melt.

To ensure that the aluminum melt flows smoothly through the nozzle, it is preferable for the inner wall of the nozzle to have a low aluminum melt wettability. To this end, it is preferable for the inner wall of the nozzle to be made of a material having a low wettability with respect to the aluminum melt, and also having a suitable degree of irregularities. JP 10-225750 A describes a method for specifying the degree of roughness on the nozzle inner wall.

Specifically, the melt feed nozzle is coated beforehand, on the inner surface that comes into contact with the aluminum melt, with a parting agent containing filler particles having a particle size distribution with a median diameter of 5 to 20 μm and a modal diameter of 4 to 12 μm. Illustrative examples of parting agents which encourage smooth flow of the aluminum melt include parting agents that use a compound such as zinc oxide or boron nitride (BN) as the filler therein. Of these, a parting agent which uses boron nitride as the filler therein is desirable. For example, the method described in JP 11-192537A may be advantageously used.

Figure 4A:
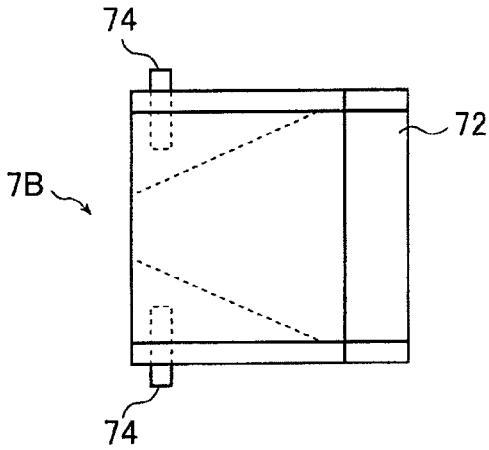
FIG. 4A is a plan view schematically showing another example of the melt feed nozzle whose tip is of a movable structure.
Figure 4B:
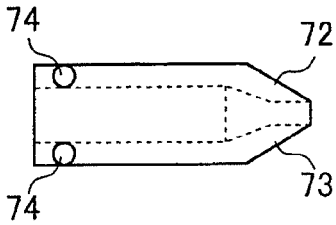
FIG. 4B is a side view of the melt feed nozzle shown in FIG. 4A.

FIG. 4A is a plan view schematically showing another example of the melt feed nozzle whose tip is of a movable structure. FIG. 4B is a side view of the melt feed nozzle shown in FIG. 4A.

In a melt feed nozzle 7B shown in FIGS. 4A and 4B, a top plate member 72 and a bottom plate member 73 are fixed with pins 74 in such a way as to allow the tip of the top plate member 72 and the tip of the bottom plate member 73 to pivot a little about the respective pins 74 in response to pressure from the aluminum melt. The respective tips of the top plate member 72 and the bottom plate member 73 can thus be brought into contact with the cooling rollers under pressure from the aluminum melt.

The cooling rollers are not subject to any particular limitation. For example, use may be made of known cooling rollers having an iron core/shell construction. When cooling rollers with a core-shell construction are used, the cooling ability at the surfaces of the cooling rollers can be increased by having cooling water flow through channels provided between the core and the shell. Moreover, the aluminum alloy plate can be set precisely to a desired thickness by further rolling the solidified aluminum.

The aluminum which has solidified at the cooling roller surface may have a tendency to stick to the cooling rollers in this state, making it difficult to continuously carry out stable casting. Hence, in the practice of the invention, a parting agent is preferably applied to the surfaces of the cooling rollers. The parting agent is preferably one having an excellent heat resistance. Suitable examples include parting agents which contain carbon graphite. The method of application is not subject to any particular limitation. A suitable example is a method in which a suspension of carbon graphite particles (preferably an aqueous suspension) is sprayed on. Spraying is preferred because the parting agent can be supplied to the cooling rollers without direct contact with the cooling rollers.

Here, if the thickness of the applied parting agent differs in the width direction and/or circumferential direction of the cooling rollers, this will have an influence on the rate of heat transfer to the cooling rollers and lead to crystal grain inhomogeneities and nonuniformity in the presence of iron and silicon. Hence, in the practice of the invention, the thickness of the parting agent that has been applied is preferably made uniform.

Specifically, one preferred method for doing so is to bring a wiper made of a refractory material or a heat-resistant cloth into contact with the surface of the cooling roller under a uniform pressure. Alternatively, if there is no danger of direct contact with the melt, the thickness of the applied parting agent can similarly be made uniform using a cloth made of cotton or the like.

Because the parting agent becomes trapped by the wiper or other thickness uniformizing means or moves to the surface of the continuously cast aluminum alloy plate, it is desirable to periodically supply fresh parting agent to the surfaces of the cooling rollers.

If the melt feed nozzle comes into nonuniform contact with the cooling rollers in the width direction, the parting agent on the surfaces of the cooling rollers will be scraped off in some areas, as a result of which the thickness of the parting agent on the surfaces of the rollers will tend to become nonuniform, which will tend to compromise the uniformity of the crystal grains.

Therefore, in the practice of the invention, the melt feed nozzle has an opening with an outer edge which does not contact the cooling rollers. Contacting the cooling rollers only at the nozzle tip is more preferred in that the above-described ripple marks can thereby be minimized.

In the practice of the invention, casting is carried out by a continuous casting process using a moving mold.

The melt is solidified at a cooling rate of 100 to 1,000° C./s. Continuous casting processes generally have a faster cooling rate than direct chill casting processes, and thus are characterized by the ability to achieve a higher solid solubility of alloying ingredients in the aluminum matrix.

When continuous casting is carried out, such as by a process involving the use of cooling rollers (e.g., the Hunter process), the melt can be directly and continuously cast as a plate having a thickness of 1 to 10 mm, thus making it possible to omit the hot rolling step.

A continuously cast plate (aluminum alloy plate) 200 obtained by casting and rolling preferably has a smaller thickness in terms of the efficiency in the cold rolling to be carried out later and usually has a thickness of 1 to 10 mm. The continuously cast plate (aluminum alloy plate) 200 is wound in a coil shape on a take-up unit 9 and is cut as appropriate by a cutter (not shown).

The method of manufacturing the aluminum alloy plate for a lithographic printing plate support of the invention suppresses vibrations at the level of the aluminum melt 100 which is present within the vessel 6. More specifically, variations in the amount of flow of the aluminum melt 100 from the melt feed nozzle 7 are suppressed by reducing the amplitude in the vertical direction at the level of the aluminum melt 100 to not more than 10 mm, whereby the continuously cast plate (aluminum alloy plate) 200 obtained has a uniform surface composition.

Figure 9A:
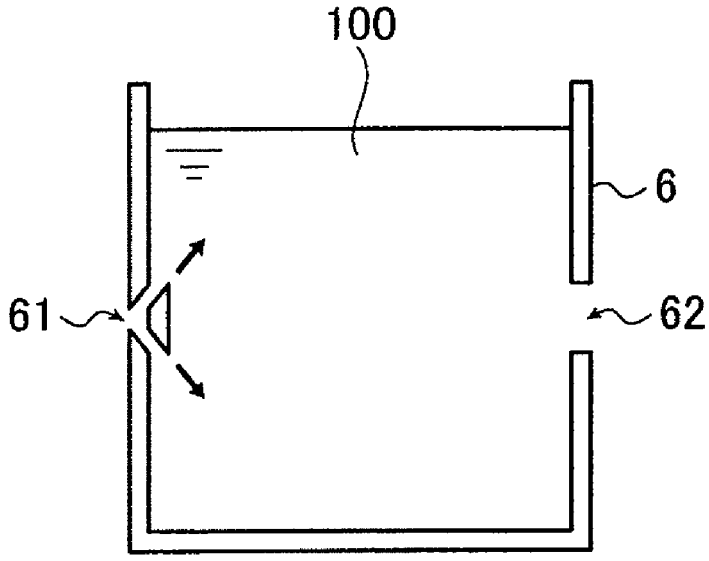
FIG. 9A is a front view showing the structure of a general vessel.
Figure 9B:
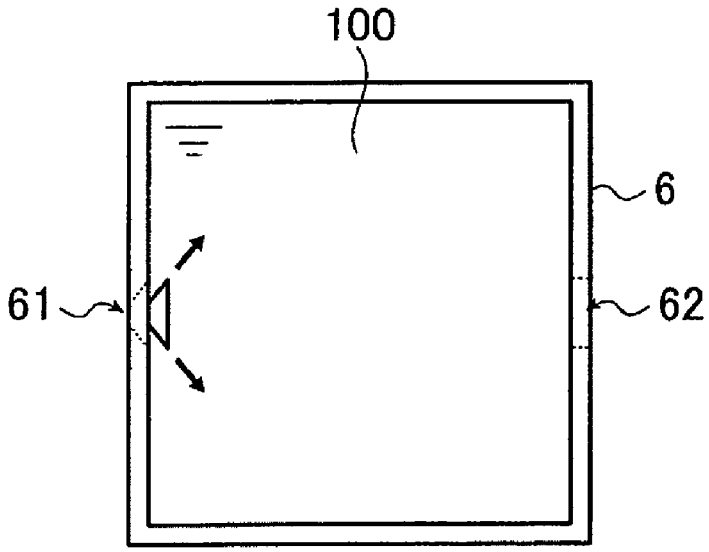
FIG. 9B is a plan view of the vessel shown in FIG. 9A.

FIG. 9A is a front view showing the structure of the general vessel 6 and FIG. 9B is a plan view of the vessel 6 shown in FIG. 9A.

Part of the aluminum melt 100 having flowed into the vessel 6 through the valve 61 provided at the inflow port directly flows toward the upper surface of the aluminum melt 100 as shown by arrows to cause vibrations at the melt level. The flow of the aluminum melt 100 forms a stationary vortical flow within the vessel 6 to cause vibrations at the melt level. Because of these factors, the aluminum melt 100 which is vibrating at the melt level is fed from an outflow port 62 to the melt flow nozzle 7 to change the amount of the aluminum melt 100 fed from the melt feed nozzle 7 whereby the continuously cast plate (aluminum alloy plate) 200 obtained by casting and rolling has a nonuniform surface composition.

In the practice of the invention, the vessel 6 has the specific shape features to be described later so that the vibrations at the level of the aluminum melt 100 within the vessel 6 are suppressed while reducing the vertical amplitude at the level of the aluminum melt 100 to 10 mm or less.

Figure 5A:
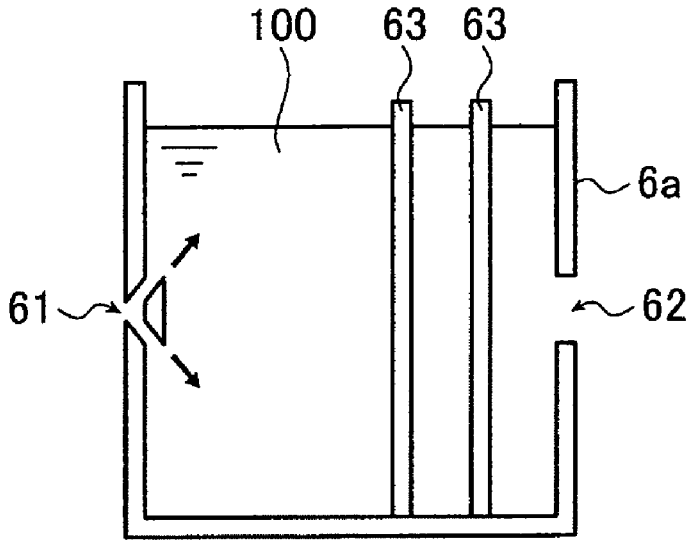
FIG. 5A is a front view showing the structure of a vessel in the invention.
Figure 5B:
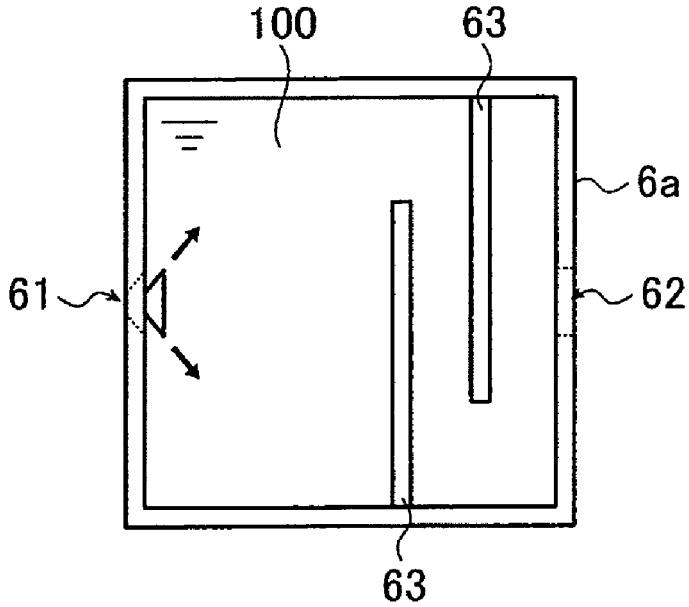
FIG. 5B is a plan view of the vessel shown in FIG. 5A.

FIG. 5A is a front view showing the structure of a vessel 6*a* in the invention and FIG. 5B is a plan view of the vessel shown in FIG. 5A.

The vessel 6*a* shown in FIGS. 5A and 5B is provided in its interior with weirs 63 which serve as the means for suppressing the vibrations at the level of the aluminum melt 100 existing within the vessel 6*a*.

The weirs 63 provided within the vessel 6*a* shown in FIGS. 5A and 5B enable the vibrations propagating at the level of the aluminum melt 100 and hence the vibrations at the level of the aluminum melt 100 existing within the vessel 6*a* to be suppressed whereby the vertical amplitude at the level of the aluminum melt 100 can be reduced to 10 mm or less.

In FIG. 5A, the weirs 63 have a larger height than the level of the aluminum melt 100. However, no particular limitation is imposed on the height of the weirs 63 as long as the vibrations at the level of the aluminum melt 100 existing within the vessel 6*a* can be suppressed, and the weirs 63 may be lower than the level of the aluminum melt 100.

Referring to FIG. 5B, the weirs 63 are provided in a direction orthogonal to the longitudinal direction of the vessel 6, that is, the axis (longitudinal axis) passing through the inflow port and the outflow port 62. However, this is not the sole case of the invention as long as the vibrations at the level of the aluminum melt 100 existing within the vessel 6*a* can be suppressed, and the weirs 63 may be provided obliquely with respect to the longitudinal axis of the vessel 6*a*. Alternatively, the weirs 63 may be provided parallel to the longitudinal axis of the vessel 6*a*.

The two weirs 63 are provided within the vessel 6*a* in FIGS. 5A and 5B. However, this is not the sole case of the invention as long as the vibrations at the level of the aluminum melt 100 existing within the vessel 6*a* can be suppressed, and the number of the weirs 63 may be one or not less than three.

Figure 6A:
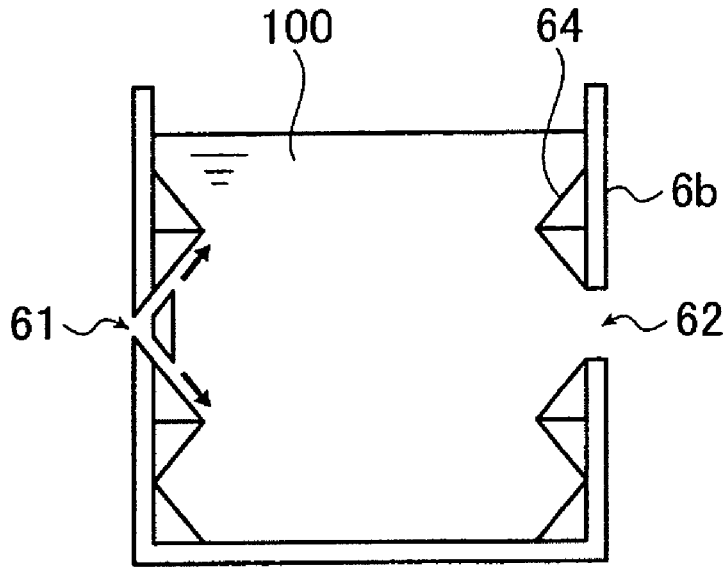
FIG. 6A is a front view showing the structure of another vessel in the invention.
Figure 6B:
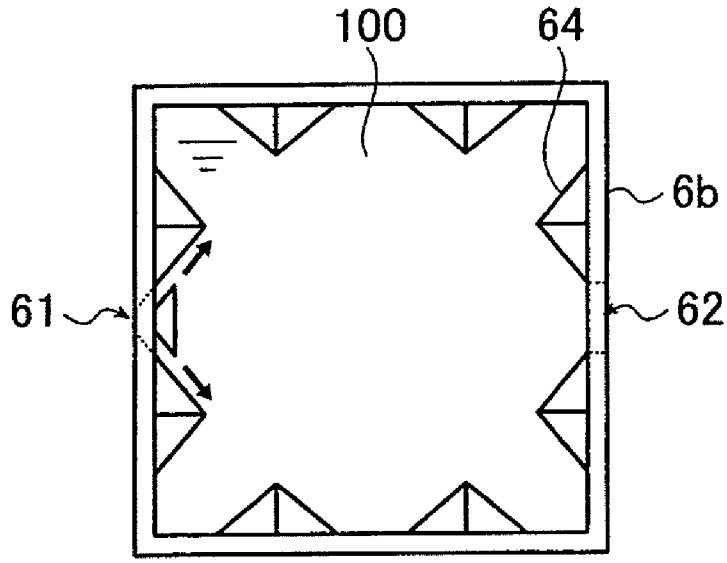
FIG. 6B is a plan view of the vessel shown in FIG. 6A.

FIG. 6A is a front view showing the structure of another vessel 6*b* in the invention and FIG. 6B is a plan view of the vessel shown in FIG. 6A.

The vessel 6*b* shown in FIGS. 6A and 6B has inner walls of a bumpy structure 64 which serve as a means for suppressing the vibrations at the level of the aluminum melt 100 existing within the vessel 6*b*.

The inner walls of such bumpy structure 64 in the vessel 6*b* shown in FIGS. 6A and 6B enable the stationary vortical flow of the aluminum melt 100 that may occur within the vessel 6*b* and therefore the vibrations at the level of the aluminum melt 100 existing within the vessel 6*b* to be suppressed, whereby the vertical amplitude at the level of the aluminum melt 100 can be reduced to 10 mm or less.

In FIG. 6B, all of the inner walls of the vessel 6*b*, more specifically all of the inner wall on the upstream side, the inner wall on the downstream side and the lateral inner walls are of the bumpy structure 64. However, this is not the sole case of the invention as long as the vibrations at the level of the aluminum melt 100 existing within the vessel 6*b* can be suppressed by providing the inner walls of the bumpy structure 64 in the vessel 6*b*. For example, the inner wall on the upstream side and the inner wall on the downstream side may only be of the bumpy structure 64. Alternatively, the lateral inner walls may only be of the bumpy structure 64, or at least one inner wall of the upstream inner wall, downstream inner wall and lateral inner walls may be of the bumpy structure 64.

The inner walls are of the bumpy structure 64 over the entire areas in the height direction in FIG. 6A and over the entire areas in the width direction in FIG. 6B. However, this is not the sole case of the invention as long as the vibrations at the level of the aluminum melt 100 existing within the vessel 6*b* can be suppressed by providing the inner walls of the bumpy structure 64 in the vessel 6*b*. Only part of the inner wall in the height direction or only part of the inner wall in the width direction may be of the bumpy structure 64.

In FIGS. 6A and 6B, the projections are triangular in section (in the shape of a quadrangular pyramid). However, this is not the sole case of the invention as long as the vibrations at the level of the aluminum melt 100 existing within the vessel 6*b* can be suppressed by providing the inner walls of the bumpy structure 64 in the vessel 6*b*. The projections may have a circular, ellipsoidal, rectangular, pentagonal or other polygonal shape in section.

No particular limitation is imposed on the height and pitch of the projections of the bumpy structure 64 formed on the inner walls of the vessel 6*b* as long as the vibrations at the level of the aluminum melt 100 existing within the vessel 6*b* can be suppressed by the bumpy structure 64 on the inner walls of the vessel 6*b*. The height and pitch of the projections in the bumpy structure 64 may be on the order of several centimeters.

Figure 7A:
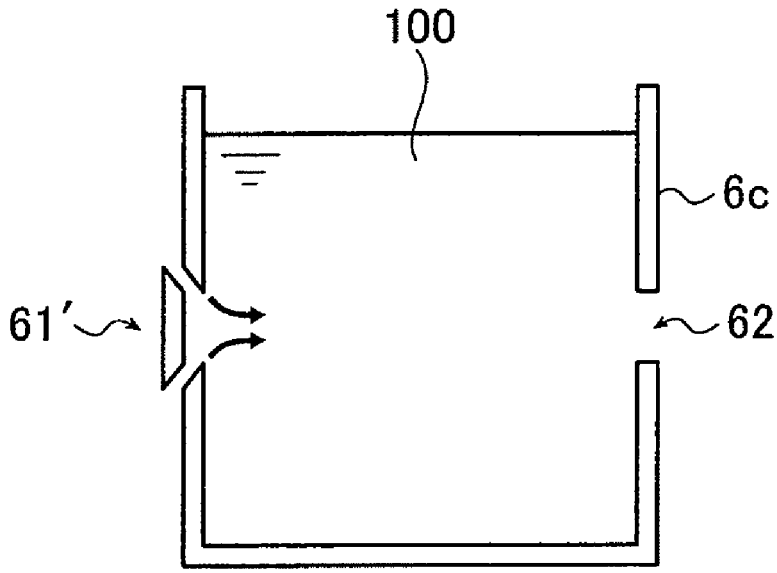
FIG. 7A is a front view showing the structure of still another vessel in the invention.
Figure 7B:
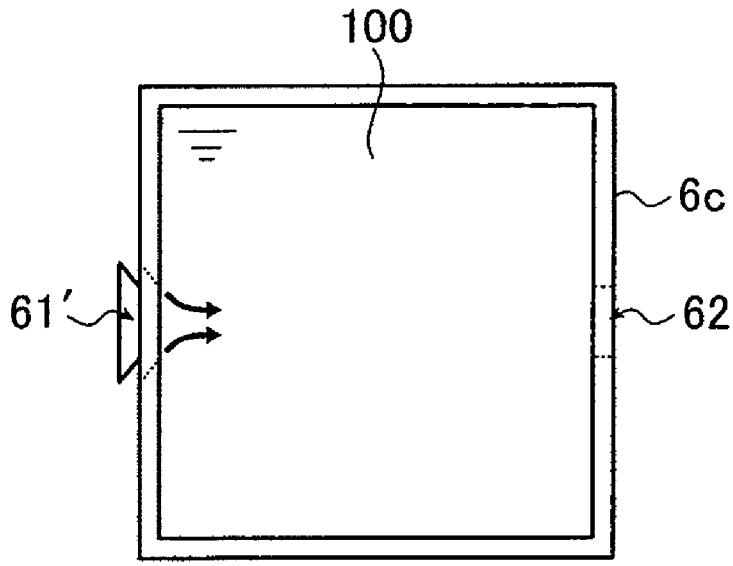
FIG. 7B is a plan view of the vessel shown in FIG. 7A.

FIG. 7A is a front view showing the structure of still another vessel 6*c* in the invention and FIG. 7B is a plan view of the vessel shown in FIG. 7A. The vessel 6*c* shown in FIGS. 7A and 7B has a valve 61' which has a different shape from the valve 61 shown in FIGS. 9A and 9B and is provided at a different position from the valve 61 shown in FIGS. 9A and 9B. In the vessel 6*c* shown in FIGS. 7A and 7B, the valve 61' serves as the means for suppressing the vibrations at the level of the aluminum melt 100 existing within the vessel 6*c*.

As in the valve 61 shown in FIGS. 9A and 9B which is provided at the inflow port of the vessel 6, a valve in the shape of a truncated cone is generally provided on the inner wall side of the vessel 6 so that the valve is positioned within the valve 61 when opened. However, in the case of using the valve 61 shown in FIGS. 9A and 9B, the inflow port is flared toward the inside of the vessel 6 and is followed by the valve 61 so that the aluminum melt 100 having flowed through the inflow port diffuses in the vessel 6 in all directions as shown by the arrows. As a result, the flow of the aluminum melt 100 within the vessel 6 has such a vector as to directly vibrate the upper surface of the aluminum melt 100.

In contrast, the vessel 6*c* shown in FIGS. 7A and 7B has the valve 61' of a truncated cone shape provided on the outer wall side of the vessel 6*c*. In other words, the valve 61' is provided so as to be positioned outside the vessel 6*c* when opened. In the case of using the valve 61' shown in FIGS. 7A and 7B, the inflow port is tapered toward the inside of the vessel 6*c* and is preceded by the valve 61' so that the aluminum melt 100 having flowed through the inflow port comes to the center of the vessel 6*c* as shown by arrows and the flow of the aluminum melt 100 within the vessel 6*c* hardly has a vector that may cause vibrations at the level of the aluminum melt 100. As a result, the vibrations at the level of the aluminum melt 100 are suppressed while reducing the vertical amplitude at the level of the aluminum melt 100 to 10 mm or less.

Figure 8A:
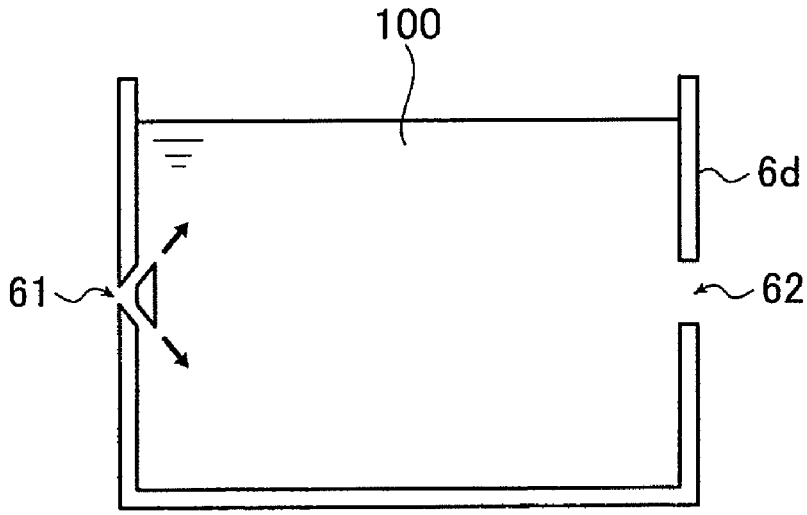
FIG. 8A is a front view showing the structure of yet another vessel in the invention.
Figure 8B:
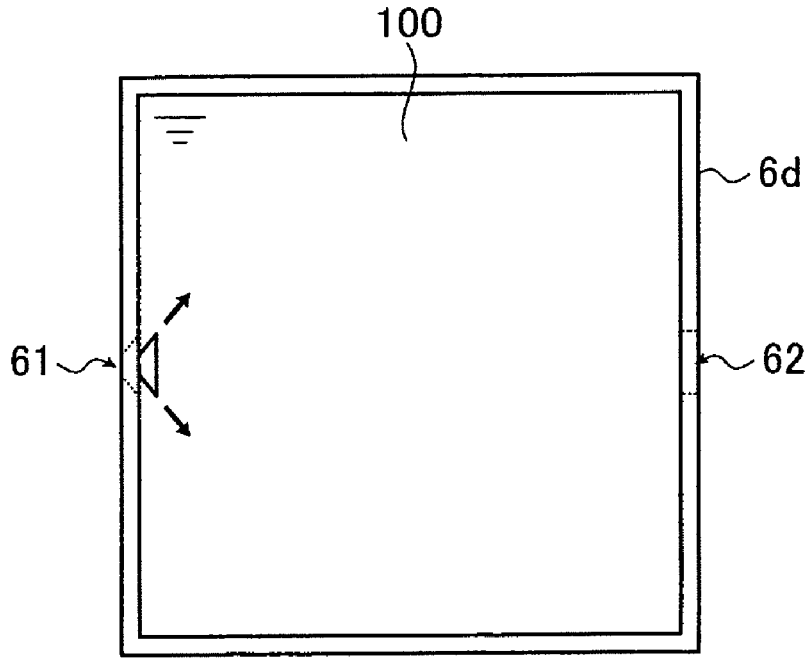
FIG. 8B is a plan view of the vessel shown in FIG. 8A.

FIG. 8A is a front view showing the structure of yet another vessel 6*d* in the invention and FIG. 8B is a plan view of the vessel shown in FIG. 8A.

The vessel 6*d* shown in FIGS. 8A and 8B has a larger opening area than the vessel 6 shown in FIGS. 9A and 9B. By increasing the opening area of the vessel 6*d* shown in FIGS. 8A and 8B, the vessel 6*d* can have a higher resistance to various causes of vibrations at the level of the aluminum melt 100. In this way, the vibrations at the level of the aluminum melt 100 are suppressed while reducing the vertical amplitude at the level of the aluminum melt 100 to 10 mm or less.

As is clear from the above-described points, the vessel 6*d* shown in FIGS. 8A and 8B has the increased opening area, which serves as the means for suppressing the vibrations at the level of the aluminum melt 100 existing within the vessel 6*d*.

In order to suppress the vibrations at the level of the aluminum melt 100 existing within the vessel 6*d*, the vessel 6*d* preferably has an opening area of at least 50×50 $cm^2$, more preferably at least 60×60 $cm^2$, and even more preferably at least 70×70 $cm^2$. The commonly used vessel 6 shown in FIGS. 9A and 9B has an opening area of about 30×30 $cm^2$.

The opening area of the vessel 6*d* shown in FIG. 8B is increased by enlarging the vessel size in both of the longitudinal and transverse directions. However, this is not the sole case of the invention as long as the vessel 6*d* has an opening area of at least 50×50 $cm^2$. The same effect can be achieved even when the opening area is increased to 50×50 $cm^2$ or more by enlarging the vessel size in one of the longitudinal and transverse directions.

In the practice of the invention, any one of the above-described means for suppressing the vibrations at the level of the melt existing within the vessel may be used, or two or more means may be used in combination. It is preferable to use two or more means in combination in terms of the effect of suppressing the vibrations at the level of the melt existing within the vessel.

In the inventive method of manufacturing the aluminum alloy plate for a lithographic printing plate, the casting step is carried out according to the above-described procedure to prepare the continuously cast plate (aluminum alloy plate) 200, after which cold rolling, intermediate annealing, finish cold rolling and flatness correction are carried out according to ordinary procedures. These procedures are described below.

<Cold Rolling>

Figure 10:
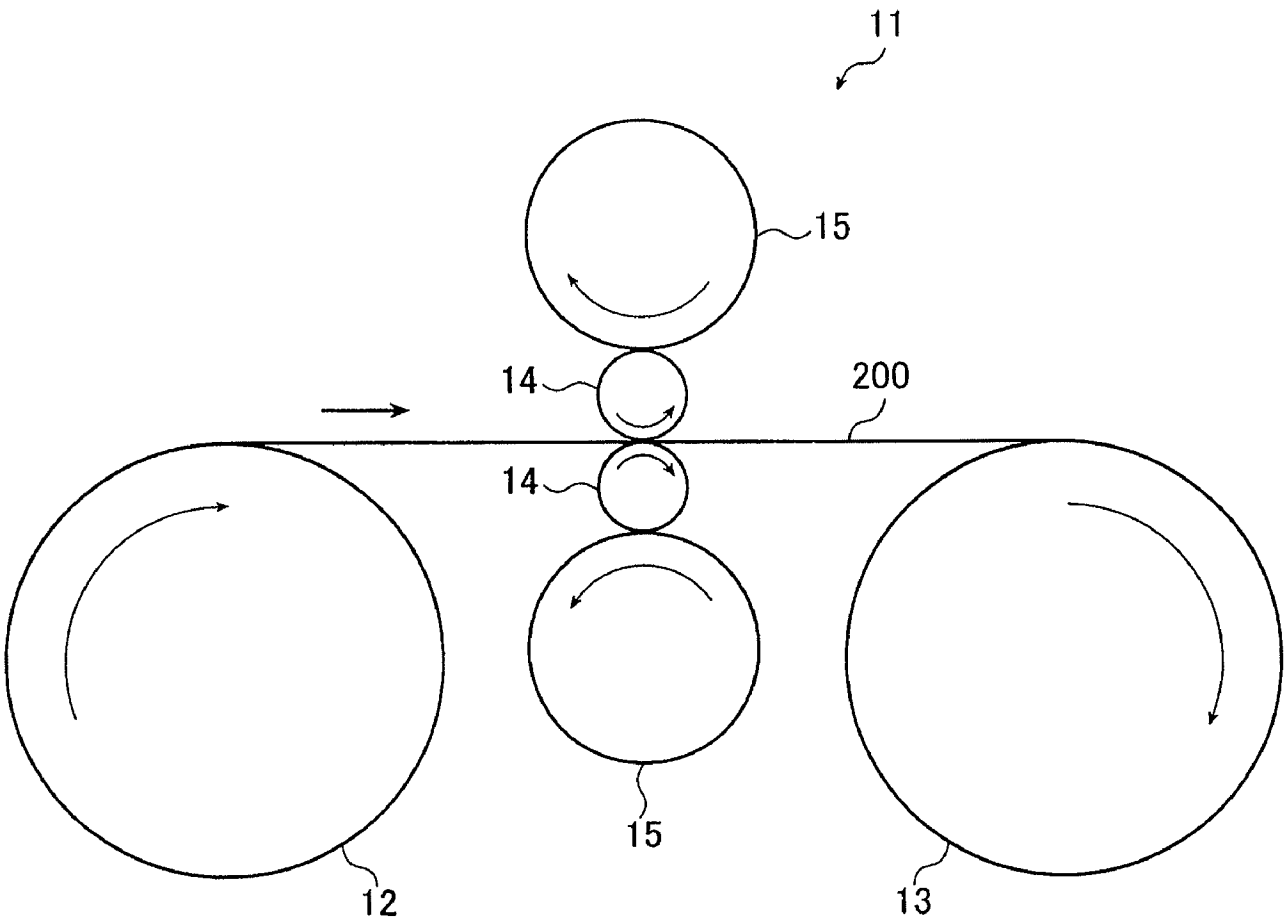
FIG. 10 is a schematic view showing an example of a cold rolling mill that may be used in cold rolling.

The continuously cast plate (aluminum alloy plate) 200 appropriately cut by a cutter (not shown) and wound in a coil shape on the take-up unit 9 in the device for continuous casting and rolling 1 shown in FIG. 1 is then subjected to cold rolling. Cold rolling is a step for reducing the thickness of the continuously cast plate (aluminum alloy plate) 200 produced by the device for continuous casting and rolling 1 shown in FIG. 1. The continuously cast plate (aluminum alloy plate) 200 can have thus a desired thickness. Cold rolling may be carried out by any method known in the art. FIG. 10 is a schematic view showing an example of the cold rolling mill that may be used in cold rolling. A cold rolling mill 11 shown in FIG. 10 carries out cold rolling by applying pressure from a pair of rolling rollers 14 rotated by their support rollers 15 to the continuously cast plate (aluminum alloy plate) 200 travelling between a feed coil 12 and a take-up coil 13.

<Intermediate Annealing>

Cold rolling is followed by intermediate annealing, which is a step in which the continuously cast plate (aluminum alloy plate) following cold rolling is heat-treated.

Unlike the conventional method using a stationary mold, the continuous casting process can essentially cool and solidify the melt very rapidly. As a result, the continuously cast plate (aluminum alloy plate) obtained by continuous casting may have considerably refined crystal grains compared with the conventional method using the stationary mold. Nevertheless, the crystal grain size is still large without further treatment and an appearance defect (unevenness after surface treatment) attributable to the crystal grain size is more likely to occur on a lithographic printing plate support obtained by carrying out surface roughening treatment on the aluminum alloy plate having undergone finish cold rolling.

Hence, when intermediate annealing is carried out after the buildup of strain in the above-described cold rolling step, the dislocations that have accumulated in the cold rolling step are released, re-crystallization occurs, and the crystal grains can be refined even further. Specifically, the crystal grains can be controlled by the reduction ratio in the cold rolling step and the heat treatment conditions (especially temperature, time and temperature rise rate) in the intermediate annealing step. For example, when continuous annealing is carried out, heating is carried out at generally 300 to 600° C. for up to 10 minutes, preferably at 400 to 600° C. for up to 6 minutes, and more preferably at 450 to 550° C. for up to 2 minutes. Moreover, the temperature rise rate is generally set to about 0.5 to 500° C./min, although the formation of smaller crystal grains can be promoted by setting the temperature rise rate to 10 to 200° C./s and by shortening the holding time following temperature rise to at most 10 minutes, and preferably 2 minutes or less.

In the case of batch annealing, the continuously cast plate is usually heated at 300 to 550° C. for at least 5 hours, preferably at 300 to 500° C. for at least 10 hours and more preferably at 350 to 490° C. for at least 10 hours. The upper limit for the annealing time is desirably up to 40 hours for each temperature.

Intermediate annealing may be carried out by any method known in the art. More specifically, use may be made of the methods described in JP 6-220593 A, JP 6-210308 A, JP 7-54111 A, and JP 8-92709 A.

<Finish Cold Rolling>

Intermediate annealing is followed by finish cold rolling, which is a step for reducing the thickness of the continuously cast plate (aluminum alloy plate) following intermediate annealing. The continuously cast plate (aluminum alloy plate) having undergone finish cold rolling preferably has a thickness of 0.1 to 0.5 mm.

Cold rolling may be carried out by any method known in the art, and for example by the same method as in the above-described cold rolling preceding intermediate annealing.

<Flatness Correction>

Flatness correction is a step for correcting the flatness of the continuously cast plate (aluminum alloy plate).

Flatness correction may be carried out by any method known in the art. For example, this step may be carried out by using a leveling machine such as a roller leveler or a tension leveler.

The flatness may be corrected after the aluminum alloy plate has been cut into discrete sheets. However, to enhance productivity, it is preferable to correct the flatness of the aluminum alloy plate in the state of a continuous coil.

Figure 11:
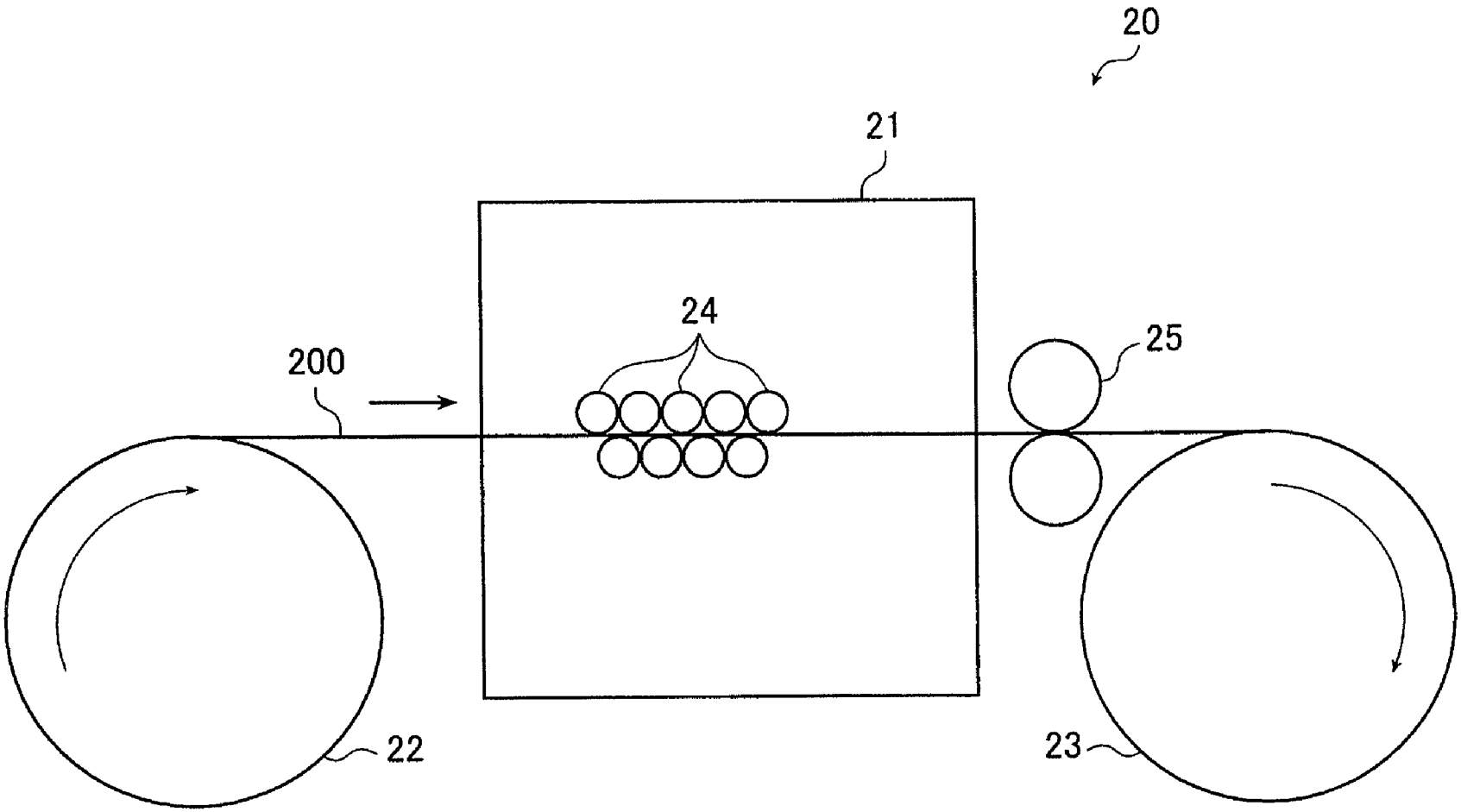
FIG. 11 is a schematic view showing an example of a leveling machine.

FIG. 11 is a schematic view showing an example of a leveling machine. A leveling machine 20 shown in FIG. 11 improves the flatness of the continuously cast plate (aluminum alloy plate) 200 traveling between a feed coil 22 and a take-up coil 23 while applying tension to the plate with a leveler 21 that includes work rolls 24. The plate is then cut to a given width with a slitter 25.

In order to cut the plate to a given width, slitting in which the plate is passed through a slitter line may also be carried out. Slitting may be carried out by any method known in the art.

An oil film-forming step in which a thin film of oil is provided on the aluminum alloy plate surface may also be carried out to prevent scuffing due to friction between adjoining aluminum alloy plates. Suitable use may be made of either a volatile or non-volatile oil film, as needed.

The continuously cast plate (aluminum alloy plate) prepared according to the above-described procedure is subjected to surface treatments to be described below in manufacturing a lithographic printing plate support therefrom. It is not always necessary to carry out all of these surface treatments but surface roughening treatment and anodizing treatment are essential. These surface treatments are not particularly limited for the number of times and may be carried out two or more times.

<Surface Roughening Treatment>

In general, mechanical graining treatment, chemical graining treatment and electrochemical graining treatment (hereinafter also referred to as "electrolytic graining treatment") are used for the surface roughening treatment singly or in combination of two or more.

In preferred embodiments to be described below, the surface roughening treatment include the following three essential treatments: electrolytic graining treatment, its subsequent liquid film-forming treatment, and its subsequent alkali etching treatment, but may include other treatments. In the practice of the invention, electrolytic graining treatment is followed by liquid film-forming treatment, and for example, an embodiment in which rinsing treatment is carried out between electrolytic graining treatment and liquid film-forming treatment is not included.

Preferred embodiments of the surface roughening treatment include a first embodiment in which first alkali etching treatment, first desmutting treatment, electrolytic graining treatment in an electrolytic solution containing nitric acid, liquid film-forming treatment, second alkali etching treatment, and second desmutting treatment are carried out in this order; a second embodiment in which mechanical graining treatment precedes the first alkali etching treatment in the first embodiment; a third embodiment in which first alkali etching treatment, first desmutting treatment, first electrolytic graining treatment in an electrolytic solution containing nitric acid, first liquid film-forming treatment, second alkali etching treatment, second desmutting treatment, second electrolytic graining treatment in an electrolytic solution containing hydrochloric acid, second liquid film-forming treatment, third alkali etching treatment, and third desmutting treatment are carried out in this order; a fourth embodiment in which mechanical graining treatment precedes the first alkali etching treatment in the third embodiment; and a fifth embodiment in which first alkali etching treatment, first desmutting treatment, electrolytic graining treatment in an electrolytic solution containing hydrochloric acid, liquid film-forming treatment, second alkali etching treatment, and second desmutting treatment are carried out in this order.

Various treatments that may be included in the surface roughening treatment are described below.

<Mechanical Graining Treatment>

Mechanical graining treatment is usually carried out for the purpose of adjusting the mean surface roughness of the aluminum alloy plate surface in a range of 0.35 to 1.0 μm.

For example, the processes described in JP 6-135175 A and JP 50-40047 B may be used for mechanical graining treatment. Mechanical graining treatment is preferably followed by electrochemical graining treatment (or the first electrochemical graining treatment in cases where electrochemical graining treatment is carried out a plurality of times).

Brush graining that may be advantageously used for mechanical graining treatment is described below.

Brush graining is generally carried out with a roller brush obtained by setting bristles, such as plastic bristles (e.g., bristles made of a plastic such as nylon, polypropylene or polyvinyl chloride), on the surface of a cylindrical roller core. Brush graining is carried out by rubbing one or both sides of the aluminum alloy plate while spraying an abrasive-containing slurry onto the rotating roller brush. The roller brush and the slurry may be replaced by a polishing roller that is a roller having a polishing layer formed on the surface thereof.

In the case of using the roller brush, the bristles on the brush that may be used have a flexural modulus of preferably 10,000 to 40,000 kg/cm$^2$, and more preferably 15,000 to 35,000 kg/cm$^2$, and have a stiffness of preferably 500 g or less, and more preferably 400 g or less. The bristles generally have a diameter of 0.2 to 0.9 mm. The bristle length may be determined as appropriate depending on the outer diameter of the roller brush and the diameter of the roller core, but the bristles generally have a length of 10 to 100 mm.

In the invention, it is preferable to use a plurality of nylon brushes, more preferably at least three nylon brushes and most preferably at least four nylon brushes. Adjustment of the number of brushes enables the wavelength components of the pits formed at the aluminum alloy plate surface to be adjusted.

The brush rollers are pressed against the aluminum alloy plate until the load on the driving motor that rotates the brushes is preferably 1 kW, more preferably 2 kW and even more preferably 8 kW greater than before the brush rollers are pressed against the plate. Adjustment of the load enables the depth of the pits formed at the aluminum alloy plate surface to be adjusted. The rotation speed of the brushes is preferably at least 100 rpm and more preferably at least 200 rpm.

Use may be made of known abrasives including pumice, silica sand, aluminum hydroxide, alumina powder, silicon carbide, silicon nitride, volcanic ash, carborundum, emery, and a mixture thereof. Of these, pumice and silica sand are preferable. Silica sand is harder and less brittle than pumice and is therefore excellent in graining efficiency. An excessive load may break particles of aluminum hydroxide, so aluminum hydroxide is appropriate in the case where formation of locally deep pits is not desired.

In terms of being excellent in graining efficiency and capable of narrowing the graining pitch, the abrasive preferably has a median diameter of 2 to 100 μm and more preferably 20 to 60 μm. Adjustment of the abrasive median diameter enables the depth of the pits formed at the aluminum alloy plate surface to be adjusted.

The abrasive is suspended in, for example, water to be used as a slurry. In addition to the abrasive, the slurry may include a thickening agent, a dispersant (e.g., a surfactant) and a preservative. The slurry preferably has a specific gravity of 0.5 to 2.

The apparatus described in JP 2002-211159 A may be used as an apparatus for carrying out mechanical graining treatment using the brushes and abrasive as described above.

A process in which a transfer roll having on its surface a predetermined pattern of irregularities is used to transfer the irregularities onto the surface of an aluminum alloy plate may be employed in the invention in place of or in addition to mechanical graining treatment by brush graining.

In the practice of the invention, such mechanical graining treatment (and in particular graining treatment using a transfer roll) may be carried out to form irregularities on the plate surface by transferring at the end of the above-described finish cold rolling.

<First Alkali Etching Treatment>

In the first alkali etching treatment, the aluminum alloy plate is brought into contact with an alkali solution so as to dissolve the surface layer.

The purpose of the first alkali etching treatment carried out prior to electrolytic graining treatment (which refers to the first electrolytic graining treatment unless otherwise specified in cases where the first and second electrolytic graining treatments are carried out; the same applies in the following description) is to smooth the roughened surface in cases where mechanical graining treatment was carried out, to form uniform pits in electrolytic graining treatment and to remove substances such as rolling oil, contaminants and a naturally oxidized film from the surface of the aluminum alloy plate in cases where no mechanical graining treatment was carried out.

The amount of material removed in the first alkali etching treatment (also referred to below as the "etching amount") is preferably at least 0.1 g/m$^2$, more preferably at least 0.5 g/m$^2$, and even more preferably at least 1 g/m$^2$, but preferably not more than 10 g/m$^2$, more preferably not more than 8 g/m$^2$ and even more preferably not more than 5 g/m$^2$. When the lower limit of the etching amount falls within the above range, uniform pits may be formed in electrolytic graining treatment, thus preventing treatment unevenness from occurring. When the upper limit of the etching amount falls within the above range, the amount of aqueous alkali solution used is decreased, which is economically advantageous.

Alkalis that may be used in the alkali solution are exemplified by caustic alkalis and alkali metal salts. Specific examples of suitable caustic alkalis include sodium hydroxide and potassium hydroxide. Specific examples of suitable alkali metal salts include alkali metal silicates such as sodium metasilicate, sodium silicate, potassium metasilicate and potassium silicate; alkali metal carbonates such as sodium carbonate and potassium carbonate; alkali metal aluminates such as sodium aluminate and potassium aluminate; alkali metal aldonates such as sodium gluconate and potassium gluconate; and alkali metal hydrogenphosphates such as disodium hydrogenphosphate, dipotassium hydrogenphosphate, sodium dihydrogenphosphate and potassium dihydrogenphosphate. Of these, caustic alkali solutions and solutions containing both a caustic alkali and an alkali metal aluminate are preferred on account of the high etch rate and low cost. An aqueous solution of sodium hydroxide is especially preferred.

In the first alkali etching treatment, the alkali solution has a concentration of preferably at least 30 g/L, and more preferably at least 300 g/L, but preferably not more than 500 g/L, and more preferably not more than 450 g/L.

It is desirable for the alkali solution to contain aluminum ions. The aluminum ion concentration is preferably at least 1 g/L, and more preferably at least 50 g/L, but preferably not more than 200 g/L, and more preferably not more than 150 g/L. Such an alkali solution can be prepared using, for example, water, a 48 wt % aqueous sodium hydroxide solution, and sodium aluminate.

In the first alkali etching treatment, the alkali solution has a temperature of preferably at least 30° C., and more preferably at least 50° C., but preferably not more than 80° C., and more preferably not more than 75° C.

In the first alkali etching treatment, the treatment time is preferably at least 1 second, and more preferably at least 2 seconds, but preferably not more than 30 seconds, and more preferably not more than 15 seconds.

When the aluminum alloy plate is continuously etched, the aluminum ion concentration in the alkali solution rises and the amount of material etched from the aluminum alloy plate changes. It is thus desirable to control the etching solution composition as follows.

First, a matrix of the electrical conductivity, specific gravity and temperature or a matrix of the conductivity, ultrasonic wave propagation velocity and temperature is prepared with respect to a matrix of the sodium hydroxide concentration and the aluminum ion concentration. The solution composition is then measured based on either the conductivity, specific gravity and temperature or the conductivity, ultrasonic wave propagation velocity and temperature, and sodium hydroxide and water are added up to control target values for the solution composition. Next, the etching solution which has increased in volume with the addition of sodium hydroxide and water is allowed to overflow from a circulation tank, thereby keeping the amount of solution constant. The sodium hydroxide added may be industrial-grade 40 to 60 wt % sodium hydroxide.

The conductivity meter and hydrometer used are preferably temperature-compensated instruments. The hydrometer is preferably a pressure differential hydrometer.

Illustrative examples of methods for bringing the aluminum alloy plate into contact with the alkali solution include passing the aluminum alloy plate through a tank filled with the alkali solution, immersing the aluminum alloy plate in a tank filled with the alkali solution, and spraying the surface of the aluminum alloy plate with the alkali solution.

The most desirable of these is a method that involves spraying the surface of the aluminum alloy plate with the alkali solution. A method in which the etching solution is sprayed from at least one spray line, and preferably two or more spray lines, each having 2 to 5 mm diameter openings spaced at a pitch of 10 to 50 mm, at a rate of 10 to 100 L/min per spray line is desirable.

Following completion of alkali etching treatment, it is desirable to remove etching solution remaining on the aluminum alloy plate with nip rollers, subject the plate to rinsing treatment with water for 1 to 10 seconds, then remove the water with nip rollers.

Rinsing treatment is preferably carried out by rinsing with a rinsing apparatus that uses a free-falling curtain of water and also by rinsing with spray lines.

Alternatively, rinsing may be carried out with a spray line having a plurality of spray tips that discharge fan-like sprays of water and are disposed along the width of the aluminum alloy plate. The interval between the spray tips is preferably 20 to 100 mm, and the amount of water discharged per spray tip is preferably 0.5 to 20 L/min. The use of a plurality of spray lines is preferred.

<First Desmutting Treatment>

After the first alkali etching treatment, it is preferable to carry out acid pickling (first desmutting treatment) to remove contaminants (smut) remaining on the surface of the aluminum alloy plate. Desmutting treatment is carried out by bringing an acidic solution into contact with the aluminum alloy plate.

Examples of acids that may be used include nitric acid, sulfuric acid, phosphoric acid, chromic acid, hydrofluoric acid and tetrafluoroboric acid.

In the first desmutting treatment which follows the first alkali etching treatment, it is preferable to use overflow from the electrolytic solution employed in electrolysis using nitric acid when it is subsequently carried out as a first electrolytic graining treatment.

The composition of the desmutting treatment solution can be controlled by selecting and using a method of control based on electrical conductivity and temperature with respect to a matrix of the acidic solution concentration and the aluminum ion concentration, a method of control based on electrical conductivity, specific gravity and temperature with respect to the above matrix, or a method of control based on electrical conductivity, ultrasonic wave propagation velocity and temperature with respect to the above matrix.

In the first desmutting treatment, it is preferable to use an acidic solution containing 1 to 400 g/L of acid and 0.1 to 5 g/L of aluminum ions.

The acidic solution has a temperature of preferably at least 20° C., and more preferably at least 30° C., but preferably not more than 70° C., and more preferably not more than 60° C.

In the first desmutting treatment, the treatment time is preferably at least 1 second, and more preferably at least 4 seconds, but preferably not more than 60 seconds, and more preferably not more than 40 seconds.

Illustrative examples of methods for bringing the aluminum alloy plate into contact with the acidic solution include passing the aluminum alloy plate through a tank filled with the acidic solution, immersing the aluminum alloy plate in a tank filled with the acidic solution, and spraying the surface of the aluminum alloy plate with the acidic solution.

Of these, a method in which the acidic solution is sprayed onto the surface of the aluminum alloy plate is preferred. A method in which the desmutting solution is sprayed from at least one spray line, and preferably two or more spray lines, each having 2 to 5 mm diameter openings spaced at a pitch of 10 to 50 mm, at a rate of 10 to 100 L/min per spray line is desirable.

Following completion of desmutting treatment, it is desirable to remove the solution remaining on the aluminum alloy plate with nip rollers, subject the plate to rinsing treatment with water for 1 to 10 seconds, then remove the water with nip rollers.

Rinsing treatment here is the same as rinsing treatment following alkali etching treatment. However, it is preferable for the amount of water discharged per spray tip to be from 1 to 20 L/min.

If overflow from the electrolytic solution used in the subsequently carried out electrolysis with nitric acid is employed as the desmutting solution in the first desmutting treatment, rather than having desmutting treatment followed by the removal of solution with nip rollers and rinsing treatment, it is preferable to handle the aluminum alloy plate up until the electrolysis step using nitric acid by suitably spraying it with the desmutting solution as needed so that the surface of the aluminum alloy plate does not dry.

<Electrolytic Graining Treatment>

Electrolytic graining treatment is one carried out in a nitric acid- or hydrochloric acid-containing aqueous solution.

In the practice of the invention, electrolytic graining treatment may include only one of an electrolytic graining treatment step in an aqueous solution containing nitric acid (hereinafter also referred to as "nitric acid electrolysis") and an electrolytic graining treatment step in an aqueous solution containing hydrochloric acid (hereinafter also referred to as "hydrochloric acid electrolysis").

In the practice of the invention, nitric acid electrolysis as the first electrolytic graining treatment is preferably followed by hydrochloric acid electrolysis as the second electrolytic graining treatment, because an aluminum alloy plate can have on its surface a grained shape formed by superimposing uniformly roughened structures on top of one another while achieving an excellent scumming resistance and a long press life.

The aluminum alloy plate having undergone electrolytic graining treatment preferably has a mean surface roughness $R_a$ of 0.2 to 1.0 μm.

(Nitric Acid Electrolysis)

Nitric acid electrolysis enables an appropriately roughened structure to be formed at the surface of the aluminum alloy plate. If the aluminum alloy plate has a relatively high copper content in the invention, nitric acid electrolysis forms relatively large and uniform recesses at the surface of the aluminum alloy plate. As a result, a lithographic printing plate manufactured using the lithographic printing plate support obtained by the invention has a long press life.

Any nitric acid-containing aqueous solution which is used in conventional electrochemical graining treatment involving the use of direct current or alternating current may be employed. The nitric acid-containing aqueous solution may be prepared by adding to an aqueous solution having a nitric acid concentration of 1 to 100 g/L at least one nitrate compound containing nitrate ions, such as aluminum nitrate, sodium nitrate or ammonium nitrate, in a range of 1 g/L to saturation. Metals which are present in the aluminum alloy, such as iron, copper, manganese, nickel, titanium, magnesium and silicon may also be dissolved in the nitric acid-containing aqueous solution. Hypochlorous acid or hydrogen peroxide may be added in an amount of 1 to 100 g/L.

More specifically, it is preferred to use a solution which has an aluminum ion concentration adjusted to 3 to 7 g/L by dissolving aluminum nitrate in an aqueous nitric acid solution having a nitric acid concentration of 5 to 15 g/L.

The nitric acid-containing aqueous solution preferably has a temperature of 20° C. to 55° C.

Nitric acid electrolysis enables pits having an average opening diameter of 1 to 10 μm to be formed. However, a relatively increased amount of electricity causes concentration of an electrolytic reaction, leading to formation of honeycomb pits having an opening diameter in excess of 10 μm as well.

To obtain such a grained surface, the total amount of electricity furnished for the anodic reaction on the aluminum alloy plate up until completion of the electrolytic reaction is preferably at least 150 C/dm$^2$, and more preferably at least 170 C/dm$^2$, but preferably not more than 600 C/dm$^2$, and more preferably not more than 500 C/dm$^2$. The peak current density is preferably from 20 to 100 A/dm$^2$ in the case of using alternating current and from 20 to 100 A/dm$^2$ in the case of using direct current.

(Hydrochloric Acid Electrolysis)

Any hydrochloric acid-containing aqueous solution which is used in conventional electrochemical graining treatment involving the use of direct current or alternating current may be employed. The hydrochloric acid-containing aqueous solution may be prepared by adding to an aqueous solution having a hydrochloric acid concentration of 1 to 30 g/L and preferably 2 to 10 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation. A compound which forms a complex with copper may also be added in an amount of 1 to 200 g/L. Metals which are present in the aluminum alloy, such as iron, copper, manganese, nickel, titanium, magnesium and silicon may also be dissolved in the hydrochloric acid-containing aqueous solution. Hypochlorous acid or hydrogen peroxide may be added in an amount of 1 to 100 g/L.

The hydrochloric acid-containing aqueous solution that may be particularly preferred is an aqueous solution prepared by adding an aluminum salt (aluminum chloride: $AlCl_3 6.H_2O$) to an aqueous solution containing 2 to 10 g/L of hydrochloric acid to adjust the aluminum ion concentration to 3 to 7 g/L and preferably 4 to 6 g/L. Electrochemical graining treatment using such an aqueous hydrochloric acid solution makes the shape of the electrolytically grained surface more uniform, and the graining treatment causes no treatment unevenness irrespective of whether a low-purity or a high-purity rolled aluminum plate is used. As a result, the lithographic printing plate obtained by using such an aluminum alloy plate can have a longer press life and a more excellent scumming resistance.

The hydrochloric acid-containing aqueous solution has a temperature of preferably at least 20° C. and more preferably at least 30° C., but preferably not more than 55° C. and more preferably not more than 50° C.

Conditions used in known electrochemical graining treatment may be employed for the substances added to the hydrochloric acid-containing aqueous solution, apparatus, power supply, current density, flow rate and temperature. In electrochemical graining, an AC power supply or a DC power supply is used, but an AC power supply is particularly preferred.

Because hydrochloric acid itself has a strong ability to dissolve aluminum, fine irregularities can be formed on the surface by slightly carrying out electrolysis. These fine irregularities have an average opening diameter of 0.01 to 0.4 μm, and are uniformly formed over the entire surface of the aluminum alloy plate. By increasing the amount of electricity (to a total amount of electricity furnished for the anodic reaction of 150 to 2000 C/dm$^2$), large pits with an average opening diameter of 1 to 30 μm are produced which have small pits with an average opening diameter of 0.01 to 0.4 μm formed on the surfaces thereof. To obtain such a grained surface, the total amount of electricity furnished for the anodic reaction on the aluminum alloy plate up until completion of the electrolytic reaction is preferably at least 10 C/dm$^2$, more preferably at least 50 C/dm$^2$, and even more preferably at least 100 C/dm$^2$, but preferably not more than 2000 C/dm$^2$, and more preferably not more than 600 C/dm$^2$.

The peak current density is preferably from 20 to 100 A/dm$^2$.

Hydrochloric acid electrolysis of the aluminum alloy plate with a large amount of electricity enables large undulations and fine irregularities to be formed at a time. Scumming resistance can be improved by making uniform the large undulations in the second alkali etching treatment to be described later.

Electrolytic graining treatment using a nitric acid-containing aqueous solution and that using a hydrochloric acid-containing aqueous solution may be carried out in accordance with the electrochemical graining processes (electrolytic graining processes) described in, for example, JP 48-28123 B and GB 896,563 B. These electrolytic graining processes use an alternating current having a sinusoidal waveform, although they may also be carried out using special waveforms like those described in JP 52-58602 A. Use can also be made of the waveforms described in JP 3-79799 A. Other processes that may be employed for this purpose include those described in JP 55-158298 A, JP 56-28898 A, JP 52-58602 A, JP 52-152302 A, JP 54-85802 A, JP 60-190392 A, JP 58-120531 A, JP 63-176187 A, JP 1-5889 A, JP 1-280590 A, JP 1-118489 A, JP 1-148592 A, JP 1-178496 A, JP 1-188315 A, JP 1-154797 A, JP 2-235794 A, JP 3-260100 A, JP 3-253600 A, JP 4-72079 A, JP 4-72098 A, JP 3-267400 A and JP 1-141094 A. In addition to the above, electrolysis can also be carried out using alternating currents of a special frequency such as have been proposed in connection with methods for manufacturing electrolytic capacitors. These are described in, for example, U.S. Pat. No. 4,276,129 and U.S. Pat. No. 4,676,879.

Various electrolytic cells and power supplies have been proposed for use in these electrolytic graining treatment steps. Use may be made of those described in, for example, U.S. Pat. No. 4,203,637, JP 56-123400 A, JP 57-59770 A, JP 53-12738 A, JP 53-32821 A, JP 53-32822 A, JP 53-32823 A, JP 55-122896 A, JP 55-132884 A, JP 62-127500 A, JP 1-52100 A, JP 1-52098 A, JP 60-67700 A, JP 1-230800 A, JP 3-257199 A, JP 52-58602 A, JP 52-152302 A, JP 53-12738 A, JP 53-12739 A, JP 53-32821 A, JP 53-32822 A, JP 53-32833 A, JP 53-32824 A, JP 53-32825 A, JP 54-85802 A, JP 55-122896 A, JP 55-132884 A, JP 48-28123 B, JP 51-7081 B, JP 52-133838 A, JP 52-133840 A, JP 52-133844 A, JP 52-133845 A, JP 53-149135 A and JP 54-146234 A.

The conductivity meter and hydrometer used are preferably temperature-compensated instruments. The hydrometer is preferably a pressure differential hydrometer.

To measure the solution composition to a high accuracy, it is preferable that samples collected from the electrolytic solution for the purpose of measurement of the solution composition be furnished for measurement after first being controlled to a fixed temperature (e.g., 40±0.5° C.) using a different heat exchanger from the one used for the electrolytic solution.

No particular limitation is imposed on the waveform of the alternating current used in electrochemical graining treatment. For example, a sinusoidal, square, trapezoidal or triangular waveform may be used.

Use can be made of an alternating current having a duty ratio of from 1:2 to 2:1. However, as noted in JP 5-195300 A, use of an alternating current having a duty ratio of 1:1 is preferred in an indirect power feed system that does not use a conductor roll to feed current to the aluminum alloy plate.

Use can be made of an alternating current having a frequency of from 0.1 to 120 Hz, although a frequency of 50 to 70 Hz is preferable from the standpoint of the equipment. At a frequency lower than 50 Hz, the carbon electrode serving as the main electrode tends to dissolve more readily. On the other hand, at a frequency higher than 70 Hz, the power supply circuit is more readily subject to the influence of inductance components thereon, increasing the power supply costs.

Any known electrolytic cell employed for surface treatment, including vertical, flat and radial type electrolytic cells, may be used to carry out electrolytic graining treatment. Radial-type electrolytic cells such as those described in JP 5-195300 A are especially preferred. The electrolytic solution is passed through the electrolytic cell either parallel or counter to the direction in which the aluminum alloy plate (aluminum web) advances.

Electrolytic solution used in conventional electrochemical graining treatment with a direct current may be used for the electrochemical graining treatment with a direct current. More specifically, electrolytes of the same type as those used in the above-described electrochemical graining treatment with an alternating current may be used.

The direct current used in electrochemical graining treatment is not particularly limited as long as the polarity of the current used does not change. Examples that may be used include a DC having a comb-shaped waveform, a continuous DC and a current obtained by fully rectifying a commercial AC with a thyristor, and a smoothed continuous DC is preferably used.

Electrochemical graining treatment with a direct current may be carried out by any of a batch process, a semicontinuous process, and a continuous process, but a continuous process is preferably used.

The apparatus used for electrochemical graining treatment with a direct current is not particularly limited, as long as the apparatus is configured to apply a dc voltage across anodes and cathodes disposed alternately and to allow an aluminum alloy plate to pass between the anodes and cathodes in pairs while keeping the distance therebetween.

The electrodes are not particularly limited but conventionally known electrodes employed in electrochemical graining treatment may be used.

Examples of the anode that may be preferably used include ones formed by plating or cladding valve metals such as titanium, tantalum and niobium with platinum-group metals; ones formed by coating or sintering platinum-group metal oxides on the valve metals; aluminum; and stainless steel. Of these, ones formed by cladding the valve metals with platinum are preferably used. The anode can have a further extended service life, for example, by a method in which the electrode is cooled by passing water inside the electrode.

Metals that do not dissolve at a negative electrode potential may be selected and used for the cathode based on Pourbaix diagrams. Carbon is particularly preferable.

The arrangement of the electrodes may be selected as appropriate for the wavy structure. The wavy structure may be adjusted by changing the length of the anode and the cathode in the direction of travel of the aluminum alloy plate, passing speed of the aluminum alloy plate, flow rate, temperature and composition of the electrolytic solution, and current density. In the case of using an apparatus including separate electrolytic cells for the anode and cathode, the electrolysis conditions in the respective cells may also be changed.

The aluminum alloy plate having undergone such electrolytic graining treatment is not subjected to rinsing treatment as described above but is conveyed to the subsequent step for liquid film-forming treatment after the electrolytic solution remaining on the plate is optionally removed with nip rollers. In cases where first and second liquid film-forming treatments are carried out, the liquid film-forming treatment refers to the "first liquid film-forming treatment" unless otherwise specified; the same applies in the following description.

<Liquid Film-Forming Treatment>

Liquid film-forming treatment is a treatment which follows the above-described electrolytic graining treatment to form a liquid film on the surface having undergone electrolytic graining treatment (electrolytically roughened surface) using an acidic solution having a pH of less than 5.

Exemplary acidic solutions that may be advantageously used include nitric acid or sulfuric acid-containing aqueous solutions.

Exemplary methods for forming a liquid film of the acidic solution on the roughened surface that may be preferably used include a method in which the acidic solution is supplied (applied) to the roughened surface using a spray line and a method in which the roughened surface is immersed in the acidic solution.

Occurrence of the appearance defects attributable to uneven surface treatment can be suppressed by providing such a liquid film of acidic solution on the roughened surface. Particularly in cases where hydrochloric acid electrolysis was carried out for electrolytic graining treatment, the aqueous hydrochloric acid solution that was present on the roughened surface following hydrochloric acid electrolysis can be replaced through liquid film-forming treatment by an acidic solution containing nitric acid or sulfuric acid with a pH of less than 5 to prevent chemical corrosion of the roughened surface as well.

Occurrence of the appearance defects is presumably because, when the aluminum alloy plate prepared by continuous casting is used to produce a lithographic printing plate support, smuts are easily generated during electrolytic graining treatment in portions corresponding to defects specific to the continuously cast member such as a nonuniform crystalline structure and segregation of trace elements on an aluminum alloy plate, that is, the above-described rippled marks, resulting in unevenness due to surface treatment. Aluminum hydroxide-based smuts that may be generated during electrolytic graining treatment firmly stick to the aluminum alloy plate surface by exposure to a neutral environment to make the appearance defects more conspicuously noticeable. Liquid film-forming treatment suppresses occurrence of such appearance defects presumably because unevenness due to surface treatment that may be caused by the defects specific to the continuously cast member such as the above-described ripple marks and in particular by the crystal orientation can be made less noticeable.

<Second Alkali Etching Treatment>

The purpose of the second alkali etching treatment carried out after liquid film-forming treatment is to dissolve the smut that arises in electrolytic graining treatment and to dissolve the edges of the pits formed by electrolytic graining treatment.

The second alkali etching treatment causes the edges of the large pits formed by electrolytic graining treatment to dissolve to smooth the plate surface, and as a result, ink does not readily catch on the edges. Therefore, a presensitized plate having an excellent scumming resistance can be obtained.

Because the second alkali etching treatment is basically the same as the first alkali etching treatment, only those features that differ are described below.

The amount of material removed from the aluminum alloy plate in the second alkali etching treatment is preferably at least 0.05 g/m$^2$, and more preferably at least 0.1 g/m$^2$, but preferably not more than 4 g/m$^2$, and more preferably not more than 3.5 g/m$^2$. At an etching amount of 0.05 g/m$^2$ or more, the edges of the pits formed in the first electrolytic graining treatment are smoothed and ink does not readily catch on the edges of the pits, thus enhancing the scumming resistance in non-image areas of the lithographic printing plate. At an etching amount of not more than 4 g/m$^2$, the irregularities formed in the first electrolytic graining treatment become larger, thus achieving a long press life.

In the second alkali etching treatment, the alkali solution has a concentration of preferably at least 30 g/L, and more preferably at least 300 g/L, but preferably not more than 500 g/L, and more preferably not more than 450 g/L.

It is desirable for the alkali solution to contain aluminum ions. The aluminum ion concentration is preferably at least 1 g/L, and more preferably at least 50 g/L, but preferably not more than 200 g/L, and more preferably not more than 150 g/L. Such an alkali solution can be prepared using, for example, water, a 48 wt % aqueous sodium hydroxide solution, and sodium aluminate.

<Second Desmutting Treatment>

After the second alkali etching treatment, it is preferable to carry out acid pickling (second desmutting treatment) to remove contaminants (smut) remaining on the surface of the aluminum alloy plate.

The second desmutting treatment can be carried out in the same manner as the first desmutting treatment.

In the second desmutting treatment, it is preferable to use nitric acid or sulfuric acid.

In the second desmutting treatment, it is preferable to use an acidic solution containing 1 to 400 g/L of acid and 0.1 to 8 g/L of aluminum ions.

In the case of using sulfuric acid, more specifically, use may be made of a solution prepared by dissolving aluminum sulfate in an aqueous sulfuric acid solution having a sulfuric acid concentration of 100 to 350 g/L so as to have an aluminum ion concentration of 0.1 to 5 g/L. Use may also be made of overflow from the electrolytic solution used in anodizing treatment to be described later.

In the second desmutting treatment, the treatment time is preferably at least 1 second, and more preferably at least 4 seconds, but preferably not more than 60 seconds, and more preferably not more than 20 seconds.

In the second desmutting treatment, the aqueous acid solution has a temperature of preferably at least 20° C. and more preferably at least 30° C., but preferably not more than 70° C. and more preferably not more than 60° C.

<Second Electrolytic Graining Treatment>

The second electrolytic graining treatment is an electrolytic graining treatment (second hydrochloric acid electrolysis) carried out in a hydrochloric acid-containing aqueous solution with an alternating current or a direct current.

The above-described electrolytic graining treatment (first electrolytic graining treatment) may only be carried out in the invention. However, the combination with the second hydrochloric acid electrolysis enables a more complex topographic structure to be formed at the aluminum alloy plate surface, thus achieving a long press life.

The second hydrochloric acid electrolysis is basically the same as the hydrochloric acid electrolysis described in connection with the electrolytic graining treatment.

The total amount of electricity furnished for the anodic reaction on the aluminum alloy plate through electrochemical graining in a hydrochloric acid-containing aqueous solution in the second hydrochloric acid electrolysis may be selected from a range of 10 to 200 C/dm$^2$ at the time electrochemical graining treatment has been finished. In order to substantially keep the surface roughened by the second electrolytic graining treatment, the total amount of electricity is preferably from 10 to 100 C/dm$^2$, and more preferably from 50 to 80 C/dm$^2$.

In cases where the surface roughening treatment that may be advantageously carried out in terms of the press life and scumming resistance includes the first alkali etching treatment, first desmutting treatment, first electrolytic graining treatment in a nitric acid-containing electrolytic solution (first nitric acid electrolysis), first liquid film-forming treatment, second alkali etching treatment, second desmutting treatment, second hydrochloric acid electrolysis, second liquid film-forming treatment, third alkali etching treatment, and third desmutting treatment, the first nitric acid electrolysis is preferably carried out with a total amount of electricity of 65 to 500 C/dm$^2$ in an anodic reaction in a nitric acid-containing electrolytic solution and the second hydrochloric acid electrolysis is preferably carried out with a total amount of electricity of 25 to 100 C/dm$^2$ in an anodic reaction in a hydrochloric acid-containing electrolytic solution.

Following optional removal of the electrolytic solution with nip rollers, the aluminum alloy plate having undergone the second hydrochloric acid electrolysis is subjected to the subsequent step for the second liquid film-forming treatment without carrying out rinsing treatment as described above.

<Second Liquid Film-Forming Treatment>

The second liquid film-forming treatment is a treatment which follows the above-described second hydrochloric acid electrolysis to thereby form a liquid film on the surface having undergone the second hydrochloric acid electrolysis (roughened surface) using an acidic solution with a pH of less than 5 and is basically the same as the above-described liquid film-forming treatment (first liquid film-forming treatment).

<Third Alkali Etching Treatment>

The purpose of the third alkali etching treatment carried out after the second liquid film-forming treatment is to dissolve the smut that arises in the second hydrochloric acid electrolysis and to dissolve the edges of the pits formed by the second hydrochloric acid electrolysis.

Because the third alkali etching treatment is basically the same as the first alkali etching treatment, only those features that differ are described below.

The amount of material removed from the aluminum alloy plate in the third alkali etching treatment is preferably at least 0.05 g/m$^2$, and more preferably at least 0.1 g/m$^2$, but preferably not more than 0.3 g/m$^2$, and more preferably not more than 0.25 g/m$^2$. At an etching amount of 0.05 g/m$^2$ or more, the edges of the pits formed in the second hydrochloric acid electrolysis are smoothed and ink does not readily catch on the edges of the pits, thus enhancing the scumming resistance in non-image areas of the lithographic printing plate. At an etching amount of not more than 0.3 g/m$^2$, the irregularities formed in the second hydrochloric acid electrolysis become larger, thus achieving a long press life.

In the third alkali etching treatment, the alkali solution has a concentration of preferably at least 30 g/L. However, to keep the irregularities formed in the preceding hydrochloric acid electrolysis with an alternating current from becoming too small, the concentration is preferably not more than 100 g/L, and more preferably not more than 70 g/L.

It is desirable for the alkali solution to contain aluminum ions. The aluminum ion concentration is preferably at least 1 g/L, and more preferably at least 3 g/L, but preferably not more than 50 g/L, and more preferably not more than 8 g/L. Such an alkali solution can be prepared using, for example, water, a 48 wt % aqueous sodium hydroxide solution, and sodium aluminate.

In the third alkali etching treatment, the alkali solution has a temperature of preferably at least 25° C., and more preferably at least 30° C., but preferably not more than 60° C., and more preferably not more than 50° C.

In the third alkali etching treatment, the treatment time is preferably at least 1 second, and more preferably at least 2 seconds, but preferably not more than 30 seconds, and more preferably not more than 10 seconds.

<Third Desmutting Treatment>

After the third alkali etching treatment, it is preferable to carry out acid pickling (third desmutting treatment) to remove contaminants (smut) remaining on the surface of the aluminum alloy plate.

The third desmutting treatment may be carried out in the same manner as the first desmutting treatment. However, in terms of removing at a higher level smuts that may be formed during electrolytic graining treatment in portions corresponding to the defects specific to the continuously cast member such as ripple marks on an aluminum alloy plate, it is preferable to use a sulfuric acid solution containing 10 to 400 g/L of sulfuric acid and 0.5 to 8 g/L of aluminum ions, and more preferably a solution adjusted to have an aluminum ion concentration of 1 to 5 g/L by dissolving aluminum sulfate in an aqueous sulfuric acid solution having a sulfuric acid concentration of 100 to 350 g/L.

In the third desmutting treatment, the treatment time is preferably at least 1 second, and more preferably at least 4 seconds, but preferably not more than 60 seconds, and more preferably not more than 15 seconds.

When the desmutting solution used in the third desmutting treatment is a solution of the same type as the electrolytic solution employed in the subsequently carried out anodizing treatment, solution removal with nip rollers and rinsing that are to be carried out after the third desmutting treatment may be omitted.

<Anodizing Treatment>

In the practice of the invention, the aluminum alloy plate having undergone the surface roughening treatment is further subjected to anodizing treatment.

Anodizing treatment may be carried out by any method commonly used in the art. More specifically, an anodized layer can be formed on the surface of the aluminum alloy plate by passing a current through the aluminum alloy plate as the anode in, for example, a solution having a sulfuric acid concentration of 50 to 300 g/L and an aluminum ion concentration of up to 5 wt %. There is no particular limitation on the solution for use in anodizing treatment as long as an oxide film can be formed on the aluminum alloy plate, and acids such as sulfuric acid, phosphoric acid, chromic acid, oxalic acid, sulfamic acid, benzenesulfonic acid and amidosulfonic acid may be used singly or in combination of two or more.

It is acceptable for at least ingredients ordinarily present in the aluminum alloy plate, electrodes, tap water, ground water and the like to be present in the electrolytic solution. In addition, secondary and tertiary ingredients may be added. Here, "second and tertiary ingredients" includes, for example, the ions of metals such as sodium, potassium, magnesium, lithium, calcium, titanium, aluminum, vanadium, chromium, manganese, iron, cobalt, nickel, copper and zinc; cations such as ammonium ions; and anions such as nitrate ions, carbonate ions, chloride ions, phosphate ions, fluoride ions, sulfite ions, titanate ions, silicate ions and borate ions. These may be present in concentrations of about 0 to 10,000 ppm.

The anodizing treatment conditions vary empirically according to the electrolytic solution used, although it is generally suitable for the solution to have an electrolyte concentration of 1 to 80 wt % and a temperature of 5 to 70° C., and for the current density to be 0.5 to 60 A/dm$^2$, the voltage to be 1 to 100 V, and the electrolysis time to be 15 seconds to 50 minutes. These conditions may be adjusted to obtain the desired anodized layer weight.

Methods that may be used to carry out anodizing treatment include those described in JP 54-81133 A, JP 57-47894 A, JP 57-51289 A, JP 57-51290 A, JP 57-54300 A, JP 57-136596 A, JP 58-107498 A, JP 60-200256 A, JP 62-136596 A, JP 63-176494 A, JP 4-176897 A, JP 4-280997 A, JP 6-207299 A, JP 5-24377 A, JP 5-32083 A, JP 5-125597 A and JP 5-195291 A.

Of these, as described in JP 54-12853 A and JP 48-45303 A, it is preferable to use a sulfuric acid solution as the electrolytic solution.

The electrolytic solution has a sulfuric acid concentration of preferably 10 to 300 g/L (1 to 30 wt %), and more preferably 50 to 200 g/L (5 to 20 wt %), and has an aluminum ion concentration of preferably 1 to 25 g/L (0.1 to 2.5 wt %), and more preferably 2 to 10 g/L (0.2 to 1 wt %). Such an electrolytic solution can be prepared by adding a compound such as aluminum sulfate to dilute sulfuric acid having a sulfuric acid concentration of 50 to 200 g/L.

Control of the electrolytic solution composition is typically carried out using a method similar to that employed in the above-described nitric acid electrolysis. That is, control is preferably effected by means of the electrical conductivity, specific gravity and temperature or of the conductivity, ultrasonic wave propagation velocity and temperature with respect to a matrix of the sulfuric acid concentration and the aluminum ion concentration.

The electrolytic solution has a temperature of preferably 25 to 55° C., and more preferably 30 to 50° C.

When anodizing treatment is carried out in an electrolytic solution containing sulfuric acid, direct current or alternating current may be applied across the aluminum alloy plate and the counter electrode.

When a direct current is applied to the aluminum alloy plate, the current density is preferably 1 to 60 A/dm$^2$, and more preferably 5 to 40 A/dm$^2$.

To keep burnt deposits (areas of the anodized layer which are thicker than surrounding areas) from arising on portions of the aluminum alloy plate due to the concentration of current when anodizing treatment is carried out as a continuous process, it is preferable to apply current at a low density of 5 to 10 A/m$^2$ at the start of anodizing treatment and to increase the current density to 30 to 50 A/dm$^2$ or more as anodizing treatment proceeds.

By carrying out anodizing treatment under such conditions, a porous film having numerous pores (micropores) can be obtained. These micropores generally have an average diameter of about 5 to 50 nm and an average pore density of about 300 to 800 pores/μm$^2$.

The weight of the anodized layer is preferably 1 to 5 g/m$^2$. At less than 1 g/m$^2$, scratches are readily formed on the plate. On the other hand, a weight of more than 5 g/m$^2$ requires a large amount of electrical power, which is economically disadvantageous. An anodized layer weight of 1.5 to 4 g/m$^2$ is more preferred. It is also desirable for anodizing treatment to be carried out in such a way that the difference in the anodized layer weight between the center of the aluminum alloy plate and areas near the edges is not more than 1 g/m$^2$.

In the practice of the invention, in terms of more improved appearance, the weight of the anodized layer is at least 2 g/m$^2$ and more preferably at least 2.5 g/m$^2$ presumably because anodizing treatment forms an anodized film while dissolving an aluminum alloy plate, and therefore smuts that may be formed during electrolytic graining treatment in portions corresponding to the defects specific to the continuously cast member such as ripple marks on the aluminum alloy plate can be removed at a higher level.

Examples of electrolysis apparatuses that may be used in anodizing treatment include those described in JP 48-26638 A, JP 47-18739 A, JP 58-24517 B and JP 2001-11698 A.

<Sealing Treatment>

In the practice of the invention, if necessary, sealing treatment may be carried out to close the micropores present in the anodized layer. Sealing treatment may be carried out in accordance with a known method, such as boiling water treatment, hot water treatment, steam treatment, sodium silicate treatment, nitrite treatment or ammonium acetate treatment. For example, sealing treatment may be carried out using the apparatuses and processes described in JP 56-12518 B, JP 4-4194 A, JP 5-202496 A and JP 5-179482 A.

<Hydrophilizing Treatment>

Hydrophilizing treatment may be carried out after anodizing treatment or after sealing treatment. Illustrative examples of suitable hydrophilizing treatments include the potassium hexafluorozirconate treatment described in U.S. Pat. No. 2,946,638, the phosphomolybdate treatment described in U.S. Pat. No. 3,201,247, the alkyl titanate treatment described in GB 1,108,559 B, the polyacrylic acid treatment described in DE 1,091,433 B, the polyvinylphosphonic acid treatments described in DE 1,134,093 B and GB 1,230,447 B, the phosphonic acid treatment described in JP 44-6409 B, the phytic acid treatment described in U.S. Pat. No. 3,307,951, the treatments involving the divalent metal salts of lipophilic organic polymeric compounds described in JP 58-16893 A and JP 58-18291 A, a treatment like that described in U.S. Pat. No. 3,860,426 in which an aqueous metal salt (e.g., zinc acetate)-containing hydrophilic cellulose (e.g., carboxymethyl cellulose) undercoat is provided, and an undercoating treatment like that described in JP 59-101651 A in which a sulfo group-bearing water-soluble polymer is applied.

Additional examples of suitable hydrophilizing treatments include those which involve undercoating the aluminum alloy plate with the phosphates mentioned in JP 62-19494 A, the water-soluble epoxy compounds mentioned in JP 62-33692 A, the phosphoric acid-modified starches mentioned in JP 62-97892 A, the diamine compounds mentioned in JP 63-56498 A, the inorganic or organic salts of amino acids mentioned in JP 63-130391 A, the carboxy or hydroxy group-bearing organic phosphonic acids mentioned in JP 63-145092 A, the amino group- and phosphonate group-containing compounds mentioned in JP 63-165183 A, the specific carboxylic acid derivatives mentioned in JP 2-316290 A, the phosphate esters mentioned in JP 3-215095 A, the compounds having one amino group and one phosphorus oxo acid group mentioned in JP 3-261592 A, the phosphate esters mentioned in JP 3-215095 A, the aliphatic or aromatic phosphonic acids (e.g., phenylphosphonic acid) mentioned in JP 5-246171 A, the sulfur atom-containing compounds (e.g., thiosalicylic acid) mentioned in JP 1-307745 A, and the phosphorus oxo acid group-bearing compounds mentioned in JP 4-282637 A.

Coloration with an acid dye as mentioned in JP 60-64352 A may also be carried out.

It is preferable to carry out hydrophilizing treatment by a method in which the aluminum alloy plate is immersed in an aqueous solution of an alkali metal silicate such as sodium silicate or potassium silicate, or is coated with a hydrophilic vinyl polymer or a hydrophilic compound so as to form a hydrophilic undercoat.

Hydrophilizing treatment with an aqueous solution of an alkali metal silicate such as sodium silicate or potassium silicate can be carried out according to the processes and procedures described in U.S. Pat. No. 2,714,066 and U.S. Pat. No. 3,181,461.

Illustrative examples of suitable alkali metal silicates include sodium silicate, potassium silicate and lithium silicate. The aqueous solution of an alkali metal silicate may include also a suitable amount of, for example, sodium hydroxide, potassium hydroxide or lithium hydroxide.

The aqueous solution of an alkali metal silicate may include also an alkaline earth metal salt or a Group 4 (Group IVA) metal salt. Examples of suitable alkaline earth metal salts include nitrates such as calcium nitrate, strontium nitrate, magnesium nitrate and barium nitrate; and also sulfates, hydrochlorides, phosphates, acetates, oxalates, and borates. Exemplary Group 4 (Group IVA) metal salts include titanium tetrachloride, titanium trichloride, titanium potassium fluoride, titanium potassium oxalate, titanium sulfate, titanium tetraiodide, zirconyl chloride, zirconium dioxide and zirconium tetrachloride. These alkaline earth metal salts and Group 4 (Group IVA) metal salts may be used singly or in combinations of two or more thereof.

The amount of silicon adsorbed as a result of alkali metal silicate treatment can be measured with a fluorescent x-ray analyzer, and is preferably about 1.0 to 15.0 mg/m$^2$.

The alkali metal silicate treatment has the effect of enhancing the resistance at the surface of the lithographic printing plate support to dissolution in an alkali developer, suppressing the leaching of aluminum components into the developer, and reducing the generation of development scum arising from developer fatigue.

<Drying>

After the lithographic printing plate support has been obtained by carrying out the above-described surface treatments, it is advantageous to dry the surface of the support before providing an image recording layer thereon. Drying is preferably carried out after the support has been rinsed with water and the water removed with nip rollers following the final surface treatment.

The drying temperature is preferably at least 70° C., and more preferably at least 80° C., but preferably not more than 110° C., and more preferably not more than 100° C.

The drying time is preferably at least 1 second, and more preferably at least 2 seconds, but preferably not more than 20 seconds, and more preferably not more than 15 seconds.

<Control of the Solution Compositions>

In the practice of the invention, it is preferable for the compositions of the various solutions used in the above-described surface treatment to be controlled by the method described in JP 2001-121837 A. This typically involves first preparing a large number of treatment solution samples to various concentrations, then measuring the ultrasonic wave propagation velocity at two solution temperatures for each sample and constructing a matrix-type data table based on the results. During treatment, it is preferable to measure the solution temperature and ultrasonic wave propagation velocity in real time and to control the concentration based on these measurements. Particularly in cases where an electrolytic solution having a sulfuric acid concentration of 250 g/L or more is used in desmutting treatment, controlling the concentration by the foregoing method is especially preferred.

The various electrolytic solutions used in electrolytic graining treatment and anodizing treatment preferably have a copper concentration of not more than 100 ppm. If the copper concentration is too high, copper will deposit onto the aluminum alloy plate when the production line stops. When the line starts moving again, the deposited copper may be transferred to the path rollers, which may cause uneven treatment.

<Surface Profile of the Lithographic Printing Plate Support>

The surface profile of the lithographic printing plate support obtained by the manufacturing method of the invention preferably has the physical property values as described below in terms of excellent printing properties of a lithographic printing plate using the lithographic printing plate support, in particular long press life and good scumming resistance.

The surface profile is measured by an atomic force microscope (AFM) to determine three-dimensional data, from which the following physical property values are calculated.

Measurement by AFM can be carried out, for example, under the following conditions.

A 1 cm square sample is cut out from the lithographic printing plate support and placed on a horizontal sample holder mounted on a piezo scanner. A cantilever is then made to approach the surface of the sample. When the cantilever reaches the zone where interatomic forces are appreciable, the surface of the sample is scanned in the X and Y directions, and the surface topography of the sample is read based on the displacement in the Z direction. A piezo scanner capable of scanning 150 μm in the X and Y directions and 10 μm in the Z direction is used. A cantilever having a resonance frequency of 120 to 400 kHz and a spring constant of 12 to 90 N/m (e.g., SI-DF20, manufactured by Seiko Instruments Inc.; NCH-10, manufactured by Nanosensors; or AC-160TS, manufactured by Olympus Corporation) is used, with measurement being carried out in the dynamic force mode (DFM). The three-dimensional data obtained is approximated by the least-squares method to compensate for slight tilting of the sample and determine a reference plane.

In the invention, measurement involves obtaining values of 50 μm square regions on the surface of the sample at 512 by 512 points. The resolution is 0.1 μm in the X and Y directions, and 1 nm in the Z direction. The scan rate is 60 μm/s.

$R_a^{50}$ as determined from the following equation using data (f(x,y)) obtained by correcting the three-dimensional data is at least 0.35 μm.

$$R_a^{50} = \frac{1}{S_0}\int_0^{L_x}\int_0^{L_y}|f(x, y)|\,dx\cdot dy$$

In this equation, $L_x$ and $L_y$ represent the length in the x direction and that in the y direction of a rectangular measurement region, respectively and $L_x=L_y=50$ μm, and $S_0$ represents the geometrically measured area and is determined by $S_0=L_x\times L_y$.

The surface area ratio $\Delta S^{50}$ calculated from the actual surface area $S_x^{50}$ determined from the three-dimensional data by three-point approximation and the geometrically measured surface area $S_0$ using the following equation: $\Delta S^{50}=(S_x^{50}-S_0)/S_0\times 100(\%)$ is from 30 to 60%.

The steepness $a45^{50(0.2\text{-}2)}$ which is the surface area ratio of portions having a gradient of at least 45° in data obtained by extracting components with a wavelength of 0.2 to 2 μm from the three-dimensional data is from 10 to 30%.

The mean surface roughness $R_a$, maximum roughness $R_{max}$, spacing $R_{sm}$ and mean slope angle $\Delta_a$ as measured by a surface roughness meter are 0.25 to 0.60 μm, 2.5 to 6.0 μm, 40 to 60 μm and 8 to 12°, respectively.

The whiteness as measured by a whiteness meter is 0.30 to 0.40.

[Presensitized Plate]

A presensitized plate can be obtained by providing an image recording layer on the lithographic printing plate support obtained by the manufacturing method of the invention. A photosensitive composition may be used to form the image recording layer.

Preferred examples of photosensitive compositions that may be preferably used in the invention include thermal positive-type photosensitive compositions containing an alkali-soluble polymeric compound and a photothermal conversion substance (such compositions and the image recording layers obtained using these compositions are referred to below as "thermal positive-type" compositions and image recording layers), thermal negative-type photosensitive compositions containing a curable compound and a photothermal conversion substance (such compositions and the image recording layers obtained therefrom are similarly referred to below as "thermal negative-type" compositions and image recording layers), photopolymerizable photosensitive compositions (referred to below as "photopolymer-type" compositions), negative-type photosensitive compositions containing a diazo resin or a photo-crosslinkable resin (referred to below as "conventional negative-type" compositions), positive-type photosensitive compositions containing a quinonediazide compound (referred to below as "conventional positive-type" compositions), and photosensitive compositions that do not require a special development step (referred to below as "non-treatment type" compositions).

Of these, thermal positive-type, thermal negative-type, photopolymer-type and non-treatment type photosensitive compositions with which the image recording layer is formed by laser direct imaging are preferred, and thermal positive-type and photopolymer-type compositions are more preferred. These preferred photosensitive compositions are described below.

<Thermal Positive-Type Photosensitive Compositions>

<Photosensitive Layer>

Thermal positive-type photosensitive compositions contain an alkali-soluble polymeric compound and a photothermal conversion substance. In a thermal positive-type image recording layer, the photothermal conversion substance converts light energy such as from an infrared laser into heat, which efficiently eliminates interactions that lower the alkali solubility of the alkali-soluble polymeric compound.

The alkali-soluble polymeric compound may be, for example, a resin having an acidic group on the molecule, or a mixture of two or more such resins. Resins having an acidic group, such as a phenolic hydroxy group, a sulfonamide group (—$SO_2NH$—R, wherein R is a hydrocarbon group) or an active imino group (—$SO_2NHCOR$, —$SO_2NHSO_2R$ or —$CONHSO_2R$, wherein R is as defined above), are especially preferred on account of their solubility in alkaline developers.

For an excellent image formability with exposure to light from an infrared laser, resins having phenolic hydroxy groups are especially desirable. Preferred examples of such resins include novolak resins such as phenol-formaldehyde resins, m-cresol-formaldehyde resins, p-cresol-formaldehyde resins, cresol-formaldehyde resins in which the cresol is a mixture of m-cresol and p-cresol, and phenol/cresol mixture-formaldehyde resins (phenol-cresol-formaldehyde co-condensation resins) in which the cresol is m-cresol, p-cresol or a mixture of m- and p-cresol.

Additional preferred examples include the polymeric compounds described in JP 2001-305722 A (especially paragraphs [0023] to [0042]), the polymeric compounds having recurring units of general formula (1) described in JP 2001-215693 A, and the polymeric compounds described in JP 2002-311570 A (especially paragraph [0107]).

To provide a good recording sensitivity, the photothermal conversion substance is preferably a pigment or dye that absorbs light in the infrared wavelength range of 700 to 1200 nm. Illustrative examples of suitable dyes include azo dyes, metal complex azo dyes, pyrazolone azo dyes, naphthoquinone dyes, anthraquinone dyes, phthalocyanine dyes, carbonium dyes, quinoneimine dyes, methine dyes, cyanine dyes, squarylium dyes, pyrylium salts and metal-thiolate complexes (e.g., nickel-thiolate complexes). Of these, cyanine dyes are preferred. The cyanine dyes of general formula (I) described in JP 2001-305722 A are especially preferred.

A dissolution inhibitor may be included in thermal positive-type photosensitive compositions. Preferred examples of dissolution inhibitors include those described in paragraphs [0053] to [0055] of JP 2001-305722 A.

The thermal positive-type photosensitive compositions preferably also include, as additives, sensitivity regulators, print-out agents for obtaining a visible image immediately after heating from light exposure, compounds such as dyes as image colorants, and surfactants for enhancing coatability and treatment stability. Compounds as described in paragraphs [0056] to [0060] of JP 2001-305722 A are preferred additives.

Use of the photosensitive compositions described in detail in JP 2001-305722 A is desirable in consideration of additional advantages as well.

The thermal positive-type image recording layer is not limited to a single layer, but may have a two-layer construction.

Preferred examples of image recording layers with a two-layer construction (also referred to as "multilayer-type image recording layers") include those comprising a bottom layer ("layer A") of excellent press life and solvent resistance which is provided on the side close to the support and a layer ("layer B") having an excellent positive-image formability which is provided on layer A. This type of image recording layer has a high sensitivity and can provide a broad development latitude. Layer B generally contains a photothermal conversion substance. Preferred examples of the photothermal conversion substance include the dyes mentioned above.

Preferred examples of resins that may be used in layer A include polymers that contain as a copolymerizable component a monomer having a sulfonamide group, an active imino group or a phenolic hydroxy group; such polymers have an excellent press life and solvent resistance. Preferred examples of resins that may be used in layer B include phenolic hydroxy group-bearing resins which are soluble in aqueous alkali solutions.

In addition to the above resins, various additives may be included, if necessary, in the compositions used to form layers A and B. For example, suitable use can be made of the various additives described in paragraphs [0062] to [0085] of JP 2002-323769 A. The additives described in paragraphs [0053] to [0060] of JP 2001-305722 A as above are also suitable for use.

The components and proportions thereof in each of layers A and B are preferably selected as described in JP 11-218914 A.

<Intermediate Layer>

It is advantageous to provide an intermediate layer between the thermal positive-type image recording layer and the support. Preferred examples of ingredients that may be used in the intermediate layer include the various organic compounds described in paragraph [0068] of JP 2001-305722 A.

An intermediate layer containing a polymer that includes an acid group-bearing monomer and an onium group-bearing monomer as described in JP 2001-108538 A is advantageously used. This intermediate layer is also advantageously used in the image recording layer of any of the other types than the thermal positive type.

<Others>

The methods described in detail in JP 2001-305722 A may be used to form a thermal positive-type image recording layer and to make a printing plate having such a layer.

<Thermal Negative-Type Photosensitive Compositions>

Thermal negative-type photosensitive compositions contain a curable compound and a photothermal conversion substance. A thermal negative-type image recording layer is a negative-type photosensitive layer in which areas irradiated with light such as from an infrared laser cure to form image areas.

<Polymerizable Layer>

An example of a preferred thermal negative-type image recording layer is a polymerizable image recording layer (polymerizable layer). The polymerizable layer contains a photothermal conversion substance, a radical generator, a radical-polymerizable compound which is a curable compound, and a binder polymer. In the polymerizable layer, the photothermal conversion substance converts absorbed infrared light into heat, and the heat decomposes the radical generator, thereby generating radicals. The radicals then trigger the chain polymerization and curing of the radical-polymerizable compound.

Illustrative examples of the photothermal conversion substance include photothermal conversion substances that may be used in the above-described thermal positive-type photosensitive compositions. Specific examples of cyanine dyes, which are especially preferred, include those described in paragraphs [0017] to [0019] of JP 2001-133969 A.

Preferred radical generators include onium salts. The onium salts described in paragraphs [0030] to [0033] of JP 2001-133969 A are especially preferred.

Exemplary radical-polymerizable compounds include compounds having one, and preferably two or more, terminal ethylenically unsaturated bonds.

Preferred binder polymers include linear organic polymers. Linear organic polymers which are soluble or swellable in water or a weakly alkaline aqueous solution are preferred. Of these, (meth)acrylic resins having unsaturated groups (e.g., allyl, acryloyl) or benzyl groups and carboxy groups in side chains are especially preferred because they provide an excellent balance of film strength, sensitivity and developability.

Radical-polymerizable compounds and binder polymers that may be used include those described specifically in paragraphs [0036] to [0060] of JP 2001-133969 A.

Thermal negative-type photosensitive compositions preferably contain additives described in paragraphs [0061] to [0068] of JP 2001-133969 A (e.g., surfactants for enhancing coatability).

The methods described in detail in JP 2001-133969 A may be used to form a polymerizable layer and to make a printing plate having such a layer.

<Acid-Crosslinkable Layer>

Another preferred thermal negative-type image recording layer is an acid-crosslinkable image recording layer (abbreviated hereinafter as "acid-crosslinkable layer"). The acid-crosslinkable layer contains a photothermal conversion substance, a thermal acid generator, a compound (crosslinker) which is curable and which crosslinks under the influence of an acid, and an alkali-soluble polymeric compound which is capable of reacting with the crosslinker in the presence of an acid. In the acid-crosslinkable layer, the photothermal conversion substance converts absorbed infrared light into heat. The heat decomposes the thermal acid generator, thereby generating an acid which causes the crosslinker and the alkali-soluble polymeric compound to react and cure.

The photothermal conversion substance is exemplified by the same substances as can be used in the polymerizable layer.

Exemplary thermal acid generators include photoinitiators for photopolymerization, dye photochromogenic substances, and heat-decomposable compounds such as acid generators which are used in microresists and the like.

Exemplary crosslinkers include hydroxymethyl- or alkoxymethyl-substituted aromatic compounds, compounds having N-hydroxymethyl, N-alkoxymethyl or N-acyloxymethyl groups, and epoxy compounds.

Exemplary alkali-soluble polymeric compounds include novolak resins and polymers having hydroxyaryl groups in side chains.

<Photopolymer-Type Photosensitive Compositions>

Photopolymer-type photosensitive compositions contain an addition-polymerizable compound, a photopolymerization initiator and a polymer binder.

Preferred addition-polymerizable compounds include compounds containing an ethylenically unsaturated bond which are addition-polymerizable. Ethylenically unsaturated bond-containing compounds are compounds which have a terminal ethylenically unsaturated bond. Such compounds may have the chemical form of a monomer, a prepolymer, or a mixture thereof. The monomers are exemplified by esters of unsaturated carboxylic acids (e.g., acrylic acid, methacrylic acid, itaconic acid, maleic acid) and aliphatic polyols, and amides of unsaturated carboxylic acids and aliphatic polyamines.

Preferred addition-polymerizable compounds include also urethane-type addition-polymerizable compounds.

The photopolymerization initiator may be any of various photopolymerization initiators or a system of two or more photopolymerization initiators (photoinitiation system) which is suitably selected according to the wavelength of the light source to be used. Preferred examples include the initiation systems described in paragraphs [0021] to [0023] of JP 2001-22079 A.

The polymer binder, inasmuch as it must function as a film-forming agent for the photopolymerizable photosensitive composition and, at the same time, must allow the image recording layer to dissolve in an alkaline developer, should be an organic polymer which is soluble or swellable in an alkaline aqueous solution. Preferred examples of such organic polymers include those described in paragraphs [0036] to [0063] of JP 2001-22079 A.

It is preferable for the photopolymer-type photosensitive composition to include the additives described in paragraphs [0079] to [0088] of JP 2001-22079 A (e.g., surfactants for improving coatability, colorants, plasticizers, thermal polymerization inhibitors).

To prevent oxygen from inhibiting polymerization, it is preferable to provide an oxygen-blocking protective layer on top of the photopolymer-type image recording layer. The polymer present in the oxygen-blocking protective layer is exemplified by polyvinyl alcohols and copolymers thereof.

It is also desirable to provide an intermediate layer or a bonding layer like those described in paragraphs [0124] to [0165] of JP 2001-228608 A.

<Conventional Negative-Type Photosensitive Compositions>

Conventional negative-type photosensitive compositions contain a diazo resin or a photo-crosslinkable resin. Among others, photosensitive compositions which contain a diazo resin and an alkali-soluble or swellable polymeric compound (binder) are preferred.

The diazo resin is exemplified by condensation products of an aromatic diazonium salt with an active carbonyl group-bearing compound such as formaldehyde; and organic solvent-soluble diazo resin inorganic salts which are the reaction products of a hexafluorophosphate or tetrafluoroborate with the condensation product of a p-diazophenylamine and formaldehyde. The high-molecular-weight diazo compounds described in JP 59-78340 A, in which the content of hexamer and larger polymers is at least 20 mol %, are especially preferred.

Exemplary binders include copolymers containing acrylic acid, methacrylic acid, crotonic acid or maleic acid as an essential component. Specific examples include the multicomponent copolymers of such monomers as 2-hydroxyethyl (meth)acrylate, (meth)acrylonitrile and (meth)acrylic acid described in JP 50-118802 A, and the multi-component copolymers of alkyl acrylates, (meth)acrylonitrile and unsaturated carboxylic acids described in JP 56-4144 A.

Conventional negative-type photosensitive compositions preferably contain as additives the print-out agents, dyes, plasticizers for imparting flexibility and wear resistance to the applied coat, development promoters and other compounds, and the surfactants for enhancing coatability described in paragraphs [0014] to [0015] of JP 7-281425 A.

Below the conventional negative-type photosensitive layer, it is advantageous to provide the intermediate layer which contains a polymeric compound having an acid group-bearing component and an onium group-bearing component described in JP 2000-105462 A.

<Conventional Positive-Type Photosensitive Compositions>

Conventional positive-type photosensitive compositions contain a quinonediazide compound. Photosensitive compositions containing an o-quinonediazide compound and an alkali-soluble polymeric compound are especially preferred.

Illustrative examples of the o-quinonediazide compound include esters of 1,2-naphthoquinone-2-diazido-5-sulfonyl chloride and a phenol-formaldehyde resin or a cresol-formaldehyde resin, and the esters of 1,2-naphthoquinone-2-diazido-5-sulfonyl chloride and pyrogallol-acetone resins described in U.S. Pat. No. 3,635,709.

Illustrative examples of the alkali-soluble polymeric compound include phenol-formaldehyde resins, cresol-formaldehyde resins, phenol-cresol-formaldehyde co-condensation resins, polyhydroxystyrene, N-(4-hydroxyphenyl)methacrylamide copolymers, the carboxy group-bearing polymers described in JP 7-36184 A, the phenolic hydroxy group-bearing acrylic resins described in JP 51-34711 A, the sulfonamide group-bearing acrylic resins described in JP 2-866 A, and urethane resins.

Conventional positive-type photosensitive compositions preferably contain as additives the compounds such as sensitivity regulators, print-out agents and dyes described in paragraphs [0024] to [0027] of JP 7-92660 A, and surfactants for enhancing coatability such as those described in paragraph [0031] of JP 7-92660 A.

Below the conventional positive-type photosensitive layer, it is advantageous to provide an intermediate layer similar to the intermediate layer which is preferably used in the case of the above-described conventional negative-type photosensitive layer.

<Non-Treatment Type Photosensitive Compositions>

Illustrative examples of non-treatment type photosensitive compositions include thermoplastic polymer powder-based photosensitive compositions, microcapsule-based photosensitive compositions, and sulfonic acid-generating polymer-containing photosensitive compositions. All of these are heat-sensitive compositions containing a photothermal conversion substance. The photothermal conversion substance is preferably a dye of the same type as those which can be used in the above-described thermal positive-type photosensitive compositions.

Thermoplastic polymer powder-based photosensitive compositions are composed of a hydrophobic, heat-meltable finely divided polymer dispersed in a hydrophilic polymer matrix. In the thermoplastic polymer powder-based image recording layer, the fine particles of hydrophobic polymer melt under the influence of heat generated by light exposure and mutually fuse, forming hydrophobic regions which serve as the image areas.

The finely divided polymer is preferably one in which the particles melt and fuse together under the influence of heat. A finely divided polymer in which the individual particles have a hydrophilic surface, enabling them to disperse in a hydrophilic component such as dampening water, is especially preferred. Preferred examples include the finely divided thermoplastic polymers described in Research Disclosure No. 33303 (January 1992), JP 9-123387 A, JP 9-131850 A, JP 9-171249 A, JP 9-171250 A and EP 931,647 A. Of these, polystyrene and polymethyl methacrylate are preferred. Illustrative examples of finely divided polymers having a hydrophilic surface include those in which the polymer itself is hydrophilic, and those in which the surfaces of the polymer particles have been rendered hydrophilic by adsorbing thereon a hydrophilic compound such as polyvinyl alcohol or polyethylene glycol.

The finely divided polymer preferably has reactive functional groups.

Preferred examples of microcapsule-type photosensitive compositions include those described in JP 2000-118160 A, and compositions like those described in JP 2001-277740 A in which a compound having thermally reactive functional groups is enclosed within microcapsules.

Illustrative examples of sulfonic acid-generating polymers that may be used in sulfonic acid generating polymer-containing photosensitive compositions include the polymers described in JP 10-282672 A that have sulfonate ester groups, disulfone groups or sec- or tert-sulfonamide groups in side chains.

Including a hydrophilic resin in a non-treatment type photosensitive composition not only provides a good on-press developability, it also enhances the film strength of the photosensitive layer itself. Preferred hydrophilic resins include resins having hydrophilic groups such as hydroxy, carboxy, hydroxyethyl, hydroxypropyl, amino, aminoethyl, aminopropyl or carboxymethyl groups; and hydrophilic binder resins of a sol-gel conversion-type.

A non-treatment type image recording layer can be developed on the press, and thus does not require a special development step. The methods described in detail in JP 2002-178655 A may be used to form a non-treatment type image recording layer and to make a printing plate having such a layer.

<Back Coat>

If necessary, the presensitized plate obtained by providing any of the various image recording layers on a lithographic printing plate support obtained according to the invention may be provided on the rear side with a coat composed of an organic polymeric compound to prevent scuffing of the image recording layer when the presensitized plates are stacked on top of each other.

[Lithographic Plate Making Process]

The presensitized plate prepared using a lithographic printing plate support obtained by the manufacturing method of the invention is then subjected to any of various treatment methods depending on the type of the image recording layer, thereby obtaining a lithographic printing plate.

Illustrative examples of sources of actinic light that may be used for imagewise exposure include mercury vapor lamps, metal halide lamps, xenon lamps and chemical lamps. Examples of laser beams that may be used include those from helium-neon lasers (He—Ne lasers), argon lasers, krypton lasers, helium-cadmium lasers, KrF excimer lasers, semiconductor lasers, YAG lasers and YAG-SHG lasers.

Following the above exposure, if the image recording layer is of a thermal positive type, thermal negative type, conventional negative type, conventional positive type or photopolymer type, it is preferable to carry out development using a developer in order to prepare a lithographic printing plate.

The developer is preferably an alkaline developer, and more preferably an alkaline aqueous solution which is substantially free of organic solvent.

Developers which are substantially free of alkali metal silicates are also preferred. One example of a suitable method of development using a developer which is substantially free of alkali metal silicates is the method described in detail in JP 11-109637 A.

Developers which contain an alkali metal silicate may also be used.

EXAMPLES

Hereinafter, the present invention is described more fully by way of examples, although the invention is not limited by the examples.

[Manufacture of Continuously Cast Plate (Aluminum Alloy Plate)]

The device for continuous casting and rolling 1 shown in FIG. 1 was used to prepare continuously cast plates (aluminum alloy plates) in Examples 1 to 4 and Comparative Example 1 as described below.

A melt 100 containing 0.1 wt % of silicon, 0.4 wt % of iron and 0.015 wt % of copper with the balance being aluminum and inadvertent impurities was prepared in the melting and holding furnace 2. In this step, the aluminum used is not limited to the one having such a composition but may be appropriately selected depending on the intended use. For example in cases where the plate is used as a material for a lithographic printing plate support, in general the composition of a 1050 material is widely used. The other 1000 series materials and 3000 series materials are also well known and based on the principle of the invention, the same effects can be expected even if any of these materials is used.

After the melt 100 has been prepared according to the above-described procedure, a crystal grain refining material in wire form (with a diameter of 10 mm) containing 5 wt % of titanium and 1 wt % of boron with the balance being aluminum and inadvertent impurities was added in the first channel 3 so that the aluminum alloy contained 0.015 wt % of titanium. The composition of the melt 100 in this step is shown in Table 1 below.

TABLE 1

| Composition (wt %) | | | | | | |
|---|---|---|---|---|---|---|
| Si | Fe | Cu | Mg | Zn | Ti | Al |
| 0.1 | 0.4 | 0.015 | 0.001 | 0.001 | 0.015 | Balance |

Then, the melt 100 was passed through the filtering means 4, second channel 5, vessel 6 provided with the liquid level controller, melt feed nozzle 7 and cooling rollers 8 to prepare a continuously cast plate (aluminum alloy plate) 200 with a plate width of about 1100 mm and a plate thickness of about 5 mm. The cooling rollers 8 were rotated at a rate of about 1.5 m/min.

Since it is desirable to minimize the distance between the melt feed nozzle 7 and the cooling rollers 8 in order to stabilize the melt meniscus (it is desirable to make the melt feed nozzle 7 and the cooling rollers 8 in contact with each other under the condition that normal casting can be continued), casting was carried out with the melt feed nozzle 7 brought in contact with the cooling rollers 8. For this step, use was made of a unit including the melt feed nozzle 7 which was composed of a top plate member coming in contact with the melt 100 from the upper side and a bottom plate member coming in contact with the melt 100 from the lower side, these upper and bottom plate members being movable in the vertical direction and being pressed against the surfaces of the adjoining cooling rollers under pressure from the melt.

The thus prepared continuously cast plate (aluminum alloy plate) 200 with a plate thickness of 5 mm was then rolled to a thickness of 1.5 mm by cold rolling, subjected to intermediate annealing at 550° C. for 10 hours, further rolled to a thickness of 0.3 mm by finish cold rolling, and subjected to flatness correction and degreasing to obtain a final continuously cast plate (aluminum alloy plate).

[Manufacture of Lithographic Printing Plate Support]

Next, the following surface treatments were carried out on the surface of the final continuously cast plate (aluminum alloy plate) to obtain a lithographic printing plate support.

<Surface Treatments>

The respective surface treatments (a) to (h) were consecutively carried out in this order.

(a) Mechanical Graining Treatment

Mechanical graining treatment was carried out with a rotating roller-type nylon brush while feeding an abrasive slurry in the form of a suspension (specific gravity, 1.12) of an abrasive (pumice having a median diameter of 40 μm) in water to the surface of the aluminum alloy plate until a mean surface roughness $R_a$ of 0.50 μm was obtained. The nylon brushes were made of 6/10 nylon and had a bristle length of 35 mm and a bristle diameter of 0.3 mm. Each brush was constructed of a 300 mm diameter stainless steel cylinder in which holes had been formed and bristles densely set (the brush had a bristle density of 450/cm$^2$). Three rotating brushes were used. The brush rollers were pressed against the aluminum alloy plate until the load on the driving motor that rotates the brushes was 7 kW greater than before the brush rollers were pressed against the plate. The direction in which the brushes were rotated was the same as the direction in which the aluminum plate was moved. The speed of rotation of the brushes was 200 rpm.

(b) Alkali Etching Treatment

The aluminum alloy plate was subjected to etching treatment by spraying with an aqueous solution having a sodium hydroxide concentration of 20 wt %, an aluminum ion concentration of 7 wt % and a temperature of 70° C. so as to dissolve 4.5 g/m$^2$ of material from the aluminum alloy plate. The plate was subsequently rinsed by spraying with water.

(c) Desmutting Treatment

Desmutting treatment was carried out by spraying the plate with an aqueous solution having a sulfuric acid concentration of 1 wt % (aluminum ion content, 0.5 wt %) and a temperature of 35° C. for 4 seconds. The plate was subsequently rinsed by spraying with water.

(d) Nitric Acid Electrolysis

Electrochemical graining treatment was consecutively carried out using a 60.0 Hz AC voltage. The electrolyte used was an aqueous solution of 1 wt % nitric acid (containing 0.5 wt % of aluminum ions) that had a liquid temperature of 35° C. Electrochemical graining treatment was carried out for a period of time TP until the current reached a peak from zero of 0.8 ms, at a duty ratio of 1:1, using an alternating current having a trapezoidal waveform, and with a carbon electrode as the counter electrode. Ferrite was used as the auxiliary anode.

The current density, which is the peak value of the current, was 30 A/dm$^2$. The amount of electricity, which is the total amount of electricity during the anode reaction at the aluminum alloy plate, was 180 C/dm$^2$. Of the current that flows from the power supply, 5% was diverted to the auxiliary anode.

(e) Liquid Film-Forming Treatment

Following the above-described nitric acid electrolysis, the surface having undergone the nitric acid electrolysis was not rinsed but was supplied with a nitric acid-containing acidic solution with a pH of 4 from a spray can to form a liquid film thereon.

(f) Etching Treatment

The aluminum alloy plate was subjected to etching treatment by spraying with an aqueous solution having a sodium hydroxide concentration of 20 wt %, an aluminum ion concentration of 7 wt % and a temperature of 50° C. so as to dissolve 0.6 g/m$^2$ of material from the aluminum alloy plate. The plate was subsequently rinsed by spraying with water.

(g) Desmutting Treatment

Desmutting treatment was carried out by spraying the plate with an aqueous solution having a sulfuric acid concentration of 17 wt % (aluminum ion content, 0.5 wt %) and a temperature of 50° C. for 4 seconds. The plate was subsequently rinsed by spraying with water.

(h) Anodizing Treatment Step

The aluminum alloy plate having undergone the above-described surface treatments (a) to (g) was then subjected to anodizing treatment using an anodizing apparatus, thereby giving a lithographic printing plate support.

The electrolyte used was an aqueous solution having a sulfuric acid concentration of 17 wt % (and containing 0.5 wt % of aluminum ions) and a temperature of 35° C. The plate was subsequently rinsed by spraying with water. The final weight of the anodized layer was 2.5 g/m$^2$.

Example 1

In Example 1, the vessel 6*a* shown in FIGS. 5A and 5B, that is, the vessel 6*a* provided with the weirs 63 was used as the means for suppressing the vibrations at the level of the melt 100 in manufacturing a continuously cast plate (aluminum alloy plate) according to the procedure described above. It was confirmed that the vibrations at the melt level were weakened each time the melt passes over the weir 63 of the vessel 6*a*, and there was no vibration at the position just before the melt feed nozzle 7. The vibrations at the level of the melt 100 within the vessel 6*a* were measured by the following procedure.

<Measurement of Vibrations at the Melt Level>

The method of measuring the vibrations at the melt level involved minutely measuring ten times the fluctuation range of the liquid level height (difference between the maximum height and the minimum height) as observed for one minute in a liquid surface portion which is closest to the outflow port of the melt in the vessel and calculating the average. The fluctuation range was measured by preparing a ceramic bar with a millimeter scale and immersing the bar in the melt. The bar desirably has the smallest possible thickness in order to minimize the adverse effects on the melt flow and the thickness was set to 3 mm.

The uniformity in the surface composition of the continuously cast plate (aluminum alloy plate) obtained by the above-described procedure and the surface evenness of the lithographic printing plate support obtained by the above-described procedure were evaluated by the following procedures.

<Evaluation of Uniformity in Surface Composition>

The uniformity in the surface composition of the continuously cast plate (aluminum alloy plate) after degreasing was evaluated under the following measurement conditions using an electron probe microanalyzer abbreviated as "EPMA" (model: JXA-8800M).

Measurement area (9 mm×9 mm); elements to be measured: iron and silicon; acceleration voltage: 20 kV; probe diameter: 30 um; dwell time: 50 ms; number of points: 300×300; interval: 30 um; number of measurement points: 5, randomly selected.

Whether or not the surface composition was uniform was evaluated on the basis of the average intensity obtained by the analysis over the whole of the target surface (9 mm×9 mm) using the EPMA. The surface composition was rated "non-uniform" when there was a region cut to a size of 0.5 mm×0.5 mm where the average intensity was at least 1.2 times or up to 0.8 times larger than the average intensity of the whole surface, and "uniform" when there was no such a region.

<Evaluation of Surface Evenness>

The lithographic printing plate support was rated "poor" when the surface unevenness was visually noticeable and "good" when it was not visually noticeable.

The results are shown in Table 2 below.

Example 2

In Example 2, the vessel 6*b* shown in FIGS. 6A and 6B, that is, the vessel 6*b* having the inner walls of the bumpy structure 64 was used as the means for suppressing the vibrations at the level of the melt 100 in manufacturing a continuously cast plate (aluminum alloy plate) according to the procedure described above.

Example 3

In Example 3, the vessel 6*c* shown in FIGS. 7A and 7B, that is, the vessel 6*c* having the valve 61' provided on the outer wall side was used in manufacturing a continuously cast plate (aluminum alloy plate) according to the procedure described above.

Example 4

In Example 4, the vessel 6*d* shown in FIGS. 8A and 8B, that is, the vessel 6*d* with an opening area of 50×50 cm$^2$ was used in manufacturing a continuously cast plate (aluminum alloy plate) according to the procedure described above.

Comparative Example 1

In Comparative Example 1, the vessel 6 shown in FIGS. 9A and 9B, that is, the vessel 6 having no means for suppressing the vibrations at the level of the melt 100 was used in manufacturing a continuously cast plate (aluminum alloy plate) according to the procedure described above.

TABLE 2

| | Vibration suppressing means | | | | Vibration | | Surface |
|---|---|---|---|---|---|---|---|
| | Weir | Bumpy structure within vessel | Valve provided outside vessel | Increased vessel opening area | width at liquid level (mm) | Uniformity in surface composition | evenness after surface treatment |
| EX 1 | Yes | No | No | No | 1 | Uniform | Good |
| EX 2 | No | Yes | No | No | 5 | Uniform | Good |
| EX 3 | No | No | Yes | No | 3 | Uniform | Good |
| EX 4 | No | No | No | Yes | 2 | Uniform | Good |
| CE 1 | No | No | No | No | 12 | Nonuniform | Poor |

The continuously cast plate (aluminum alloy plate) having a uniform surface composition as obtained by the invention may be used as a material of an aluminum support for a lithographic printing plate.

What is claimed is:

1. A method of manufacturing an aluminum alloy plate for a lithographic printing plate by continuous casting which comprises feeding an aluminum alloy melt through a melt feed nozzle between a pair of cooling rollers and rolling the aluminum alloy melt while solidifying between the pair of cooling rollers, wherein a vessel for feeding the aluminum alloy melt to the melt feed nozzle contains the aluminum alloy melt which is adjusted in such a manner that a vertical amplitude at a level of the aluminum alloy melt existing within the vessel is 10 mm or less, wherein one or more weirs are provided within the vessel as a means for reducing the vertical amplitude at the level of the aluminum alloy melt existing within the vessel to 10 mm or less.

2. A method of manufacturing an aluminum alloy plate for a lithographic printing plate by continuous casting which comprises feeding an aluminum alloy melt through a melt feed nozzle between a pair of cooling rollers and rolling the aluminum alloy melt while solidifying between the pair of cooling rollers, wherein a vessel for feeding the aluminum alloy melt to the melt feed nozzle contains the aluminum alloy melt which is adjusted in such a manner that a vertical amplitude at a level of the aluminum alloy melt existing within the vessel is 10 mm or less, wherein the vessel is provided with inner walls of a bumpy structure as a means for reducing the vertical amplitude at the level of the aluminum alloy melt existing within the vessel to 10 mm or less, wherein a height and pitch of the projections in the bumpy structure are on the order of several centimeters.

3. A method of manufacturing an aluminum alloy plate for a lithographic printing plate by continuous casting which comprises feeding an aluminum alloy melt through a melt feed nozzle between a pair of cooling rollers and rolling the aluminum alloy melt while solidifying between the pair of cooling rollers, wherein a vessel for feeding the aluminum alloy melt to the melt feed nozzle contains the aluminum alloy melt which is adjusted in such a manner that a vertical amplitude at a level of the aluminum alloy melt existing within the vessel is 10 mm or less, wherein a valve is provided on an outer wall side of the vessel from an inflow port through which the aluminum alloy melt is flowed into the vessel and is used as a means for reducing the vertical amplitude at the level of the aluminum alloy melt existing within the vessel to 10 mm or less.

4. A method of manufacturing an aluminum alloy plate for a lithographic printing plate by continuous casting which comprises feeding an aluminum alloy melt through a melt feed nozzle between a pair of cooling rollers and rolling the aluminum alloy melt while solidifying between the pair of cooling rollers, wherein a vessel for feeding the aluminum alloy melt to the melt feed nozzle contains the aluminum alloy melt which is adjusted in such a manner that a vertical amplitude at a level of the aluminum alloy melt existing within the vessel is 10 mm or less, wherein the vessel with an upper opening area of at least $50\times50\ cm^2$ is used as a means for reducing the vertical amplitude at the level of the aluminum alloy melt existing within the vessel to 10 mm or less.

* * * * *